US010770789B2

(12) United States Patent
Pu et al.

(10) Patent No.: US 10,770,789 B2
(45) Date of Patent: Sep. 8, 2020

(54) ANTENNA STRUCTURE

(71) Applicant: HTC Corporation, Taoyuan (TW)

(72) Inventors: Ta-Chun Pu, Taoyuan (TW); Chien-Ting Ho, Taoyuan (TW); Yen-Liang Kuo, Taoyuan (TW)

(73) Assignee: HTC Corporation, Taoyuan (TW)

( * ) Notice: Subject to any disclaimer, the term of this patent is extended or adjusted under 35 U.S.C. 154(b) by 24 days.

(21) Appl. No.: 16/249,905

(22) Filed: Jan. 17, 2019

(65) Prior Publication Data

US 2020/0235471 A1 Jul. 23, 2020

(51) Int. Cl.

| | |
|---|---|
| ***H01Q 21/00*** | (2006.01) |
| ***H01Q 3/24*** | (2006.01) |
| ***H01Q 1/36*** | (2006.01) |
| ***H01Q 1/24*** | (2006.01) |
| ***H01Q 15/16*** | (2006.01) |

(52) U.S. Cl.

CPC ..... *H01Q 3/247* (2013.01); *H01Q 1/241* (2013.01); *H01Q 1/36* (2013.01); *H01Q 15/165* (2013.01)

(58) Field of Classification Search

None

See application file for complete search history.

(56) References Cited

U.S. PATENT DOCUMENTS

2004/0233118 A1 11/2004 Jocher
2010/0026601 A1* 2/2010 Chang ..... H01L 23/585 343/834
2014/0028515 A1* 1/2014 Lu ..... H01Q 1/36 343/793
2016/0104934 A1* 4/2016 Jang ..... H01Q 1/38 343/834

FOREIGN PATENT DOCUMENTS

TW 200637068 A 10/2006

OTHER PUBLICATIONS

Corresponding Taiwan office action dated Mar. 5, 2020.

* cited by examiner

*Primary Examiner* — Anh Q Tran

(74) *Attorney, Agent, or Firm* — CKC & Partners Co., LLC

(57) ABSTRACT

An antenna structure includes a substrate, a vertical radiator, a reflective structure and a horizontal metal branch. The vertical radiator is in the substrate. The reflective structure is laterally disposed external to the vertical radiator. The horizontal metal branch is coupled to the reflective structure.

19 Claims, 19 Drawing Sheets

ANTENNA STRUCTURE

BACKGROUND

Technical Field

The invention relates to an antenna structure, and more particularly to an antenna structure with a radiator unit disposed at an edge of a substrate.

Description of Related Art

With the vigorous development of communication technologies, commercial mobile communication systems can achieve high-speed data transmission, and provide Internet service providers with a wide range of services, such as network services of multimedia video streaming, instant road reporting and navigation, and instant network communication that require huge data transmission quantity. For hardware, an antenna design affects the performance of wireless signals transmitting and receiving. Therefore, how to design a high-performance antenna is one of the goals in the related industries.

SUMMARY

The objective of the invention is to provide an antenna structure that has radiation pattern switching functions of switching its radiation pattern based on its surrounding environment, thus achieving high transmission and reception performances under various environments.

One aspect of the invention relates to an antenna structure which includes a substrate, a vertical radiator, a reflective structure and a vertical radiator. The vertical radiator is in the substrate. The reflective structure is laterally disposed external to the vertical radiator. The horizontal metal branch is coupled to the reflective structure.

Another aspect of the invention relates to an antenna structure which includes a substrate and plural radiator units. The radiator units are in the substrate, and each of the radiator units includes a vertical radiator, a reflective structure and a horizontal metal branch. The reflective structure is laterally disposed external to the vertical radiator. The horizontal metal branch is coupled to the reflective structure. At least two of the horizontal metal branches of the radiator units belong to two different layers of the substrate.

Another aspect of the invention relates to an antenna structure which includes a substrate, plural vertical radiators, a reflective structure and plural horizontal radiators. The vertical radiators are in the substrate and are spaced from each other. The reflective structure is laterally disposed external to the vertical radiators and has plural first portions and at least one second portion, in which each first portion extends from the second portion toward a nearest one of side edges of the substrate, and the second portion extends substantially parallel to at least one of the side edges of the substrate. The horizontal metal branches are respectively coupled to the first portions of the reflective structure and are respectively associated with the vertical radiators.

BRIEF DESCRIPTION OF THE DRAWINGS

The disclosure can be more fully understood by reading the following detailed description of the embodiment, with reference made to the accompanying drawings as follows.

DETAILED DESCRIPTION

Figure 1A:
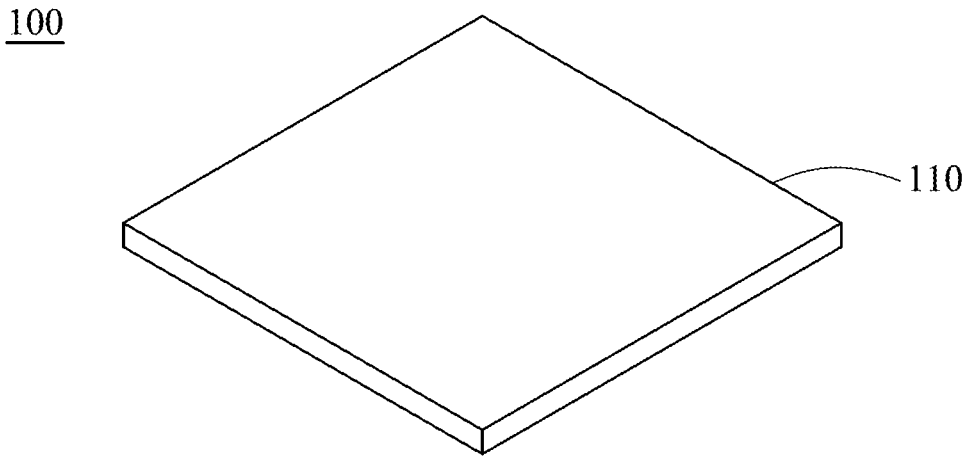
FIG. 1A and FIG. 1B are respectively a perspective view and a top view of an antenna structure in accordance with some embodiments of the invention.

The spirit of the disclosure is clearly described hereinafter accompanying with the drawings and detailed descriptions. After realizing preferred embodiments of the disclosure, any persons having ordinary skill in the art may make various modifications and changes according to the techniques taught in the disclosure without departing from the spirit and scope of the disclosure.

Terms used herein are only used to describe the specific embodiments, which are not used to limit the claims appended herewith. Unless limited otherwise, the term "a," "an," "one" or "the" of the single form may also represent the plural form. Further, the spatially relative terms are intended to encompass different orientations of the device in use or operation in addition to the orientation depicted in the figures.

The document may repeat reference numerals and/or letters in the various examples. This repetition is for the purpose of simplicity and clarity and does not in itself dictate a relationship between the various embodiments and/or configurations discussed.

Further, spatially relative terms, such as "over," "on," "under," "below," and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The structure may be otherwise oriented (rotated 90 degrees or at other orientations) and the spatially relative descriptors used herein may likewise be interpreted accordingly.

Figure 1B:
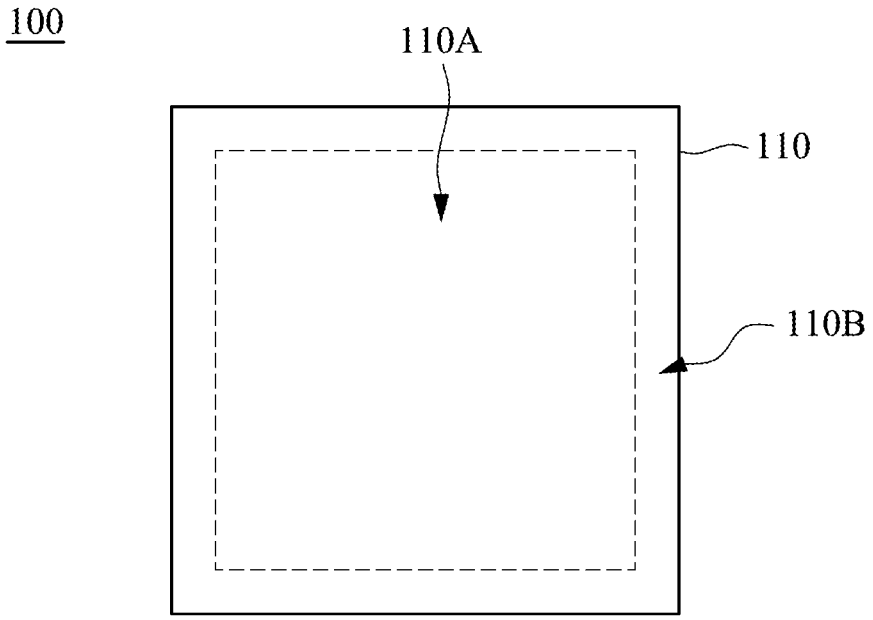

Referring to FIG. 1A and FIG. 1B, FIG. 1A and FIG. 1B are respectively a perspective view and a top view of an antenna structure 100. The antenna structure 100 include at least a substrate 110 and components disposed on or in the substrate 110, such as radiation elements, conductive lines, switches and/or other components. The substrate 110 has a center area 110A and a peripheral area 110B. The center area 110A has components for transmitting electrical signals, while the peripheral area 110B has radiators.

Figure 2:
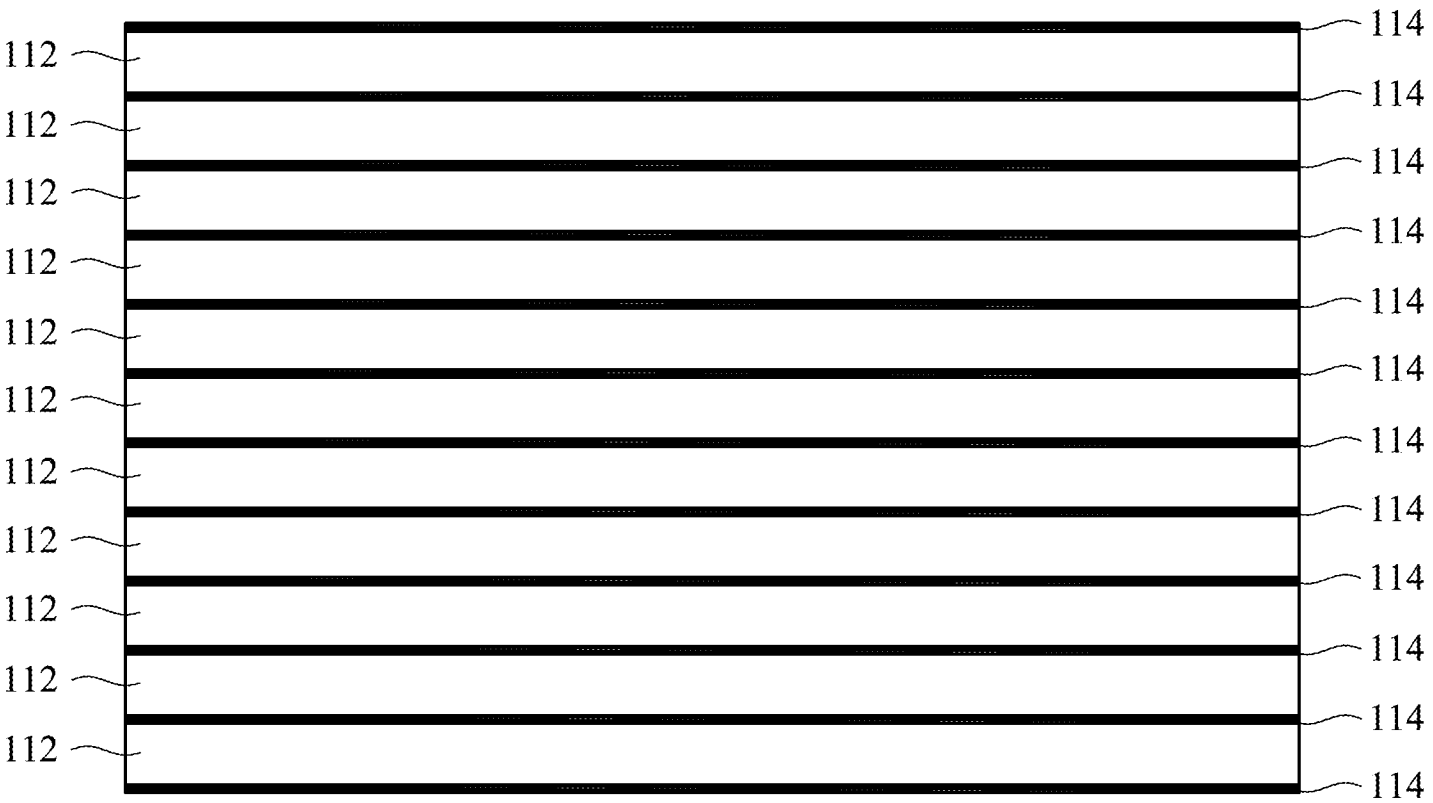
FIG. 2 is a cross sectional view of the antenna structure in FIG. 1A.

FIG. 2 is a cross sectional view of the antenna structure 100 in FIG. 1A. As shown in FIG. 2, the substrate 110 is a multi-layered board structure formed of alternately stacked dielectric layers 112 and metal layers 114. Each dielectric layer 112 may be formed from FR4 material, glass, ceramic, epoxy resin or silicon, and each metal layer 114 may be formed from copper, aluminum, nickel and/or another material. In addition, each metal layer 114 may include a radiator element, a conductive line, a switch or another component needed to form a radiation structure and an electrical signal transmission structure. The metal layers 114 may include different patterns based on the components formed in the metal layers 114. Moreover, the substrate 110 may be formed by various processes, such as low-temperature cofired ceramic (LTCC), integrated passive device (IPD), multi-layered film, multi-layered printed circuit board (PCB) or another multi-layered process based on the material type of the dielectric layers 112.

Figure 3:
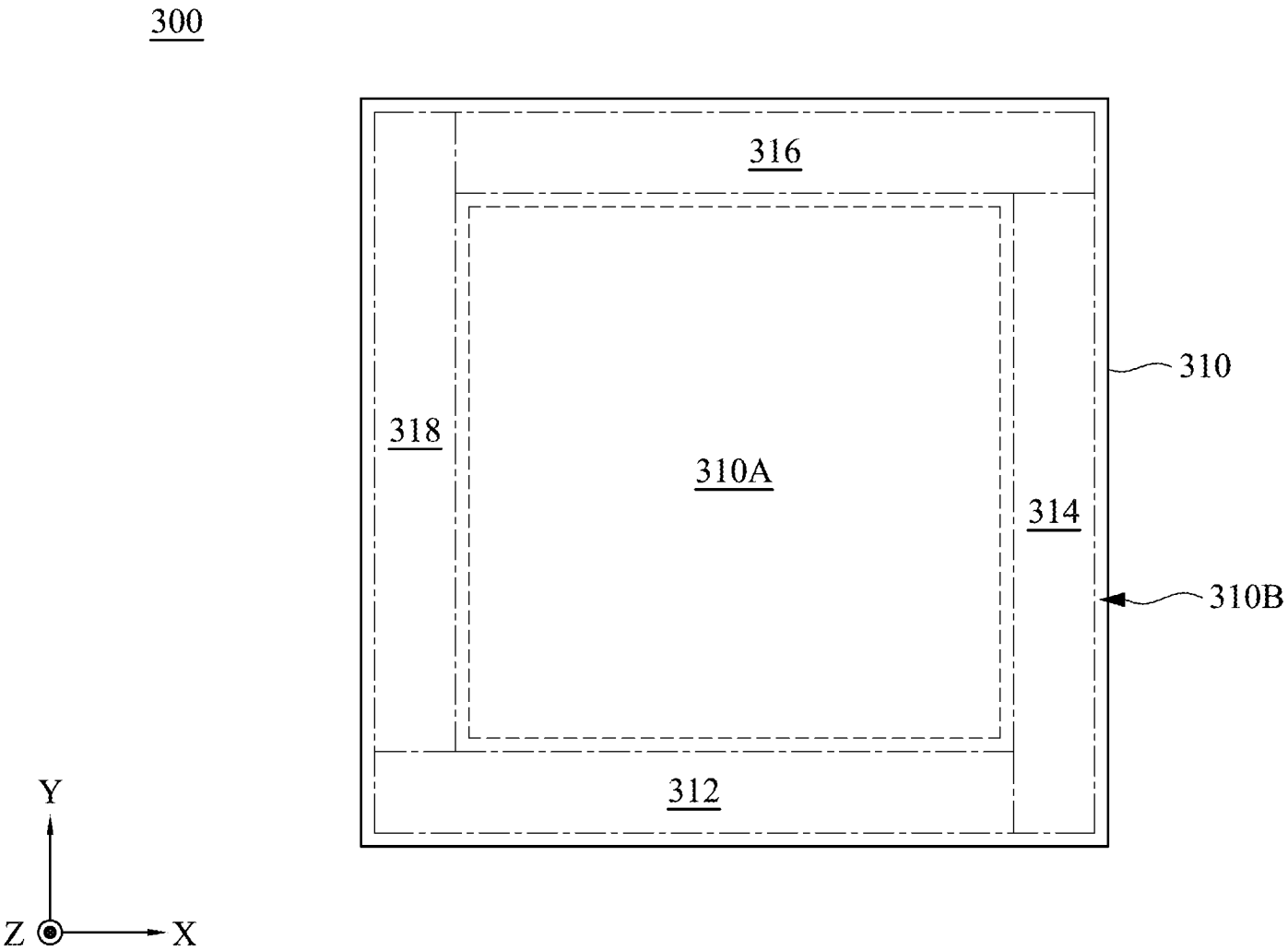
FIG. 3 is a schematic diagram of an antenna structure in accordance with some embodiments of the invention.

FIG. 3 is a schematic diagram of an antenna structure 300 in accordance with some embodiments of the invention. Similar to the antenna structure 100 in FIG. 1A, the antenna structure 300 includes at least a substrate 310 and components disposed on or in the substrate 310, such as radiation elements, conductive lines, switches and/or other components, the substrate 310 has a center area 310A and a peripheral area 310B, in which components for transmitting electrical signals may be disposed in the center area 310A, and one or more radiators may disposed in the peripheral area 310B. In detail, the peripheral area 310B is separated into four areas 312, 314, 316, 318 respectively at four side edges of the substrate 310, and a radiator may be optionally disposed in each of the regions 312, 314, 316, 318. In addition, the substrate 310 is a multi-layered board structure, which may be similar to the structured formed of alternately stacked dielectric layers 112 and metal layers 114 as illustrated in FIG. 2.

Figure 4:
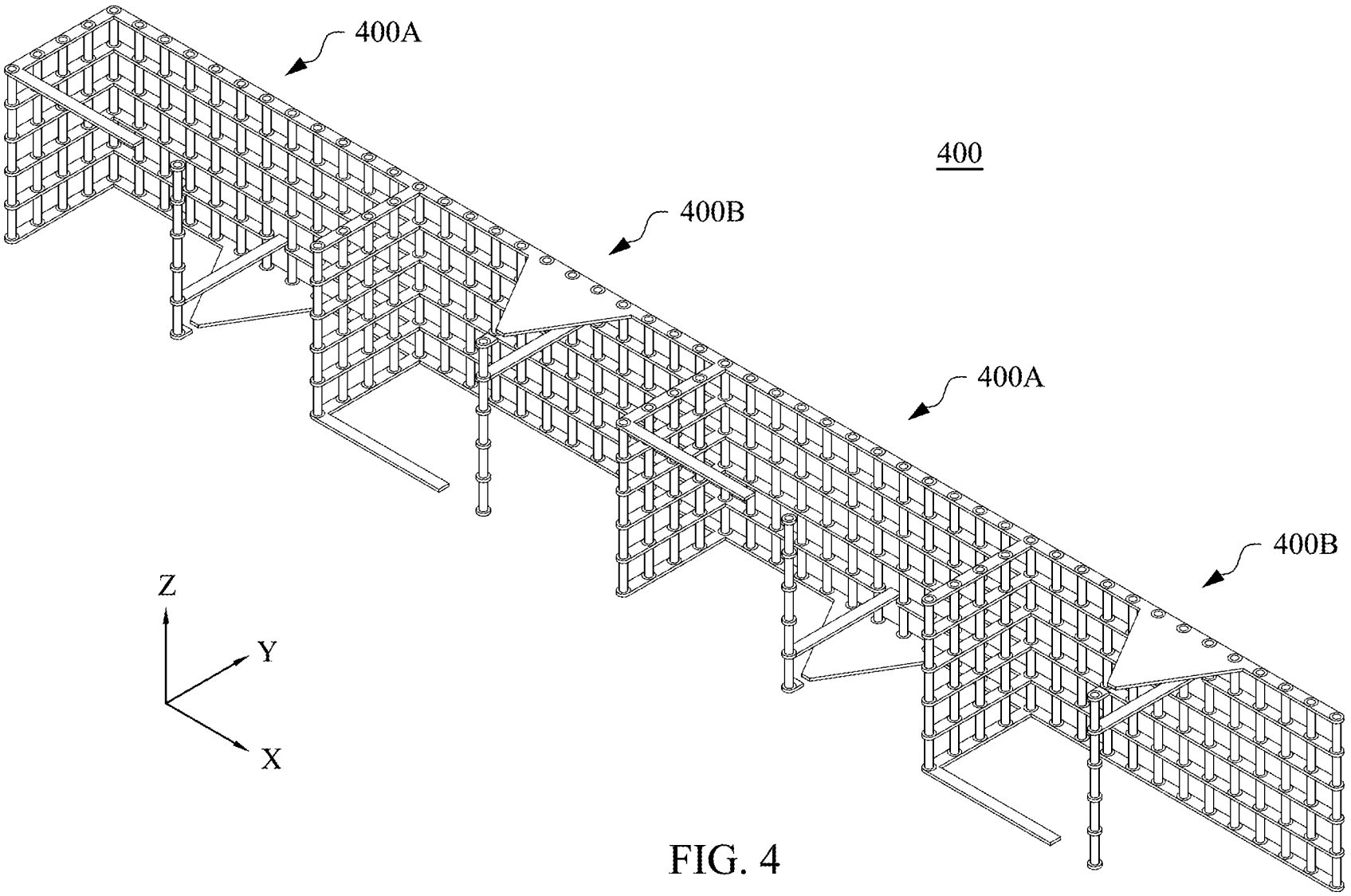
FIG. 4 is a perspective view of a radiator set in accordance with some embodiments of the invention.

FIG. 4 is a perspective view of a radiator set 400 in accordance with some embodiments of the invention. The radiator set 400 is formed of alternately arranged radiator units 400A, 400B. As shown in FIG. 4, the radiator units 400A, 400B have different three-dimensional patterns. In some embodiments, the three-dimensional patterns of the radiator units 400A, 400B are upside down with respect to each other, so as to further adjust the symmetry, the radiation pattern and the overall antenna structure 300. FIG. 4 is exemplified as the radiator set 400 arranged in the area 312 of the antenna structure 300. In various embodiments, the radiator set 400 may be disposed in each of the areas 312, 314, 316, 318 of the antenna structure 300.

Figure 5A:
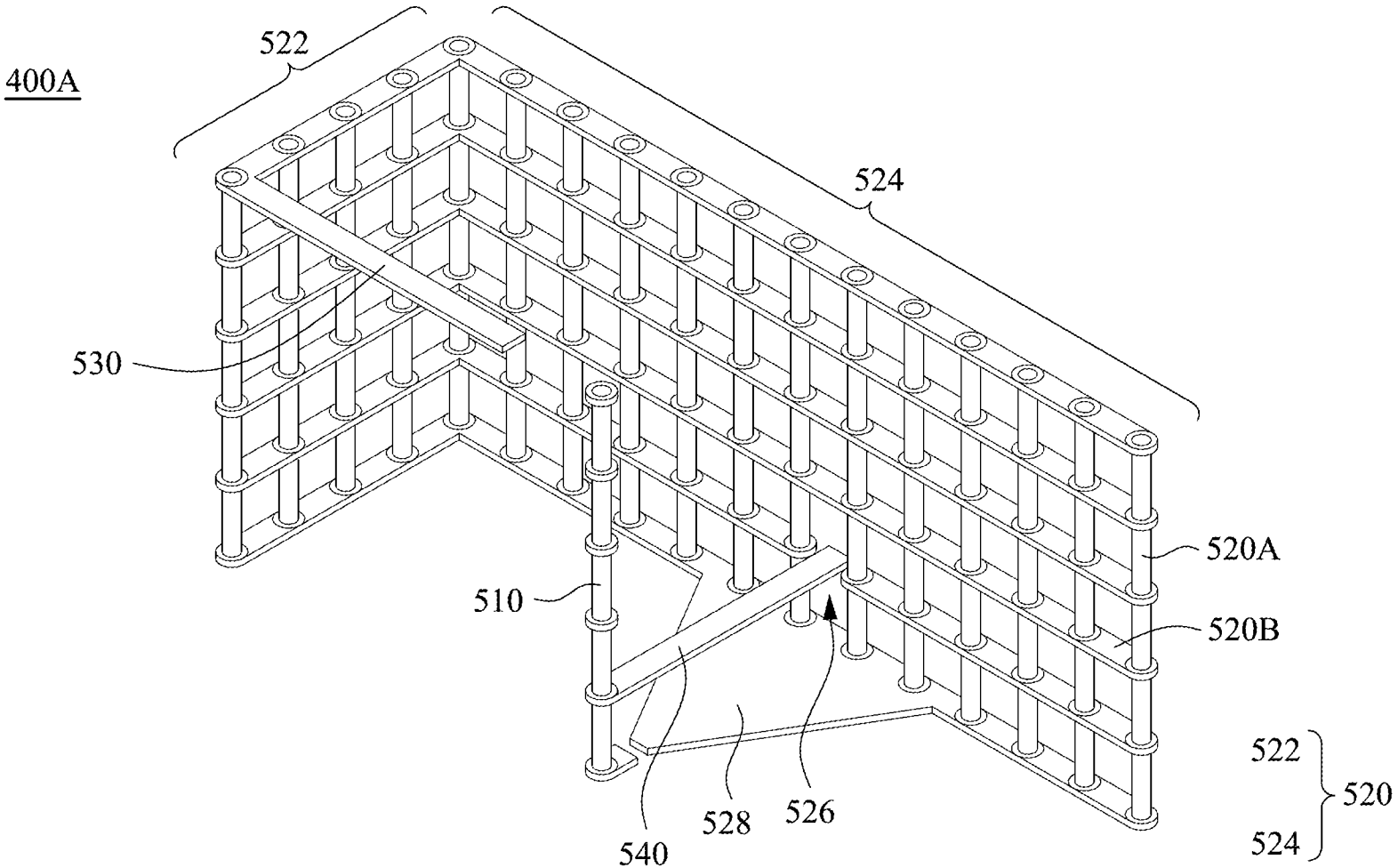
FIG. 5A and FIG. 5B are respectively a perspective view and a top view of the radiator unit in FIG. 4.
Figure 5B:
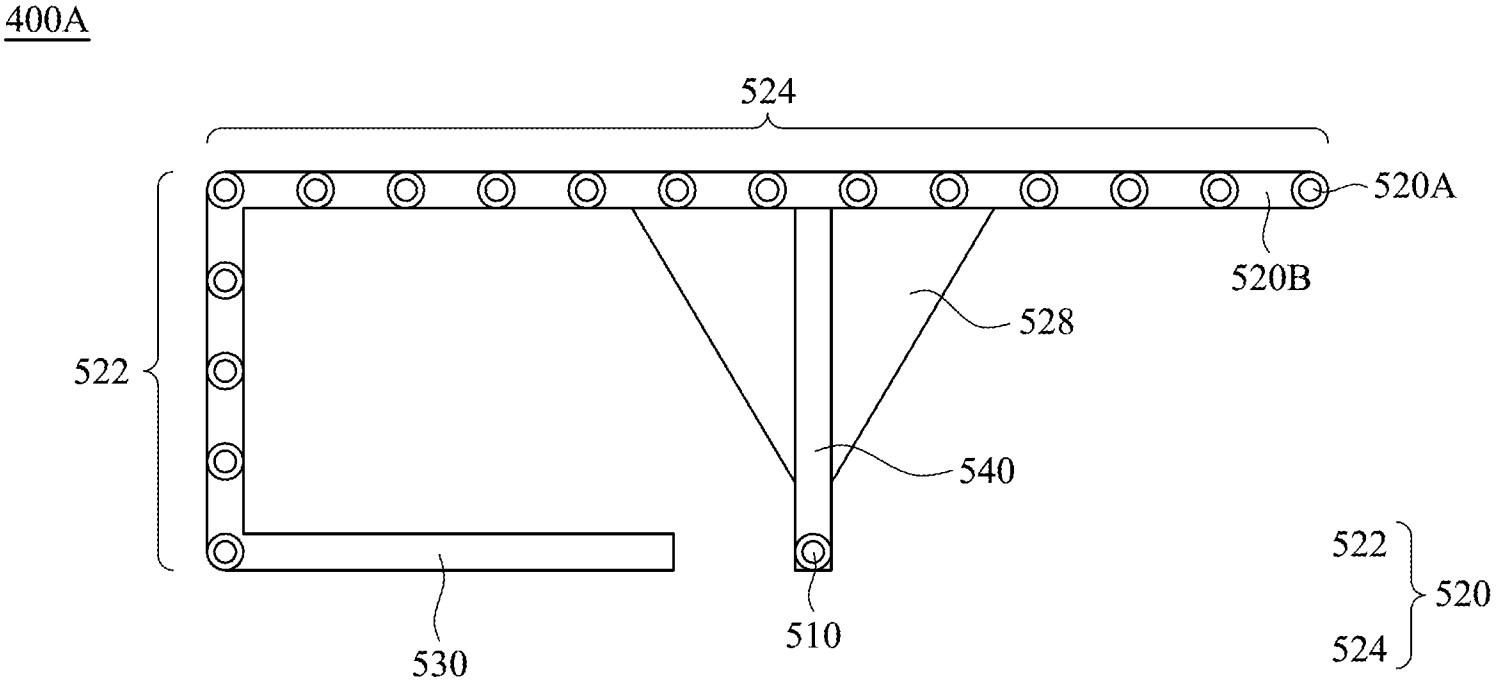

FIG. 5A and FIG. 5B are respectively a perspective view and a top view of the radiator unit 400A in FIG. 4. The radiator unit 400A includes a vertical radiator 510, a reflective structure 520, a horizontal metal branch 530 and a feeding trace 540, in which the vertical radiator 510 is coupled to the feeding trace 540, while the reflective structure 520 is laterally disposed external to the vertical radiator 510 and is coupled to the horizontal metal branch 530.

The vertical radiator 510 is used to generate a vertically polarized radiation pattern. The vertical radiator 510 vertically crosses multiple dielectric layers in the substrate 310, of which the length may be near to or approximately ¼ of the equivalent wavelength of the electromagnetic wave in the substrate 310. The vertical radiator 510 is formed of a through substrate via (TSV) conductor. In practical, the TSV conductors may be conductive by coating conductive liquid/paint or plating conductive metal in the fabricating process. The vertical radiator 510 may be a blind via structure, a buried via structure or a through via structure, based on the thickness of the substrate 310, the number of the metal layers in the substrate 310 and the arrangement of the vertical radiator 510 in the substrate 310.

The reflective structure 520 is formed of the vertical conductors 520A and the planar metal structures 520B, in which the vertical conductors 520A extend along the direction perpendicular to the planar direction of the substrate 310, while the planar metal structures 520B extend along the planar direction of the substrate 310 and are electrically connected through the vertical conductors 320A. In the embodiment, the distance between the neighboring vertical radiators 520A is less than ¼ of the equivalent wavelength of the electromagnetic wave in the substrate 310.

Similar to the vertical radiator 510, the vertical conductors 520A are formed of TSV conductors. The vertical conductors 520A may be formed of one or more types. As shown in FIG. 5, the lengths of the vertical radiator 510 and the vertical conductors 520A are the same, and similarly, the vertical conductors 520A may be blind via structures, buried via structures or through via structures, based on the number of the metal layers in the substrate 310 and the arrangements of the vertical conductors 520A in the substrate 310. However, embodiments of the invention are not limited thereto. In various embodiments, according to design requirements, the vertical conductors 520A may include blind via structures, buried via structures and/or through via structures. In addition, in another embodiment, the vertical radiator 510 and the vertical conductors 520A may have different lengths and/or different height positions.

In addition, the vertical radiator 510 and the vertical conductors 520A may be plated conductive via structures, in which conductive material is plated onto the walls of the via holes, such as copper, gold, aluminum, nickel or another metal, and then a conductive material or an insulating material (e.g. air or epoxy resin) is filled or plugged into the remained spaces, or a conductive material or an insulating material is plugged to form plugged via structures, or a solder mask is disposed on the top and/or the bottom of the spaces to form tented via structures. In another embodiment, the vertical radiator 510 and the vertical conductors 520A may be non-plated conductive via structures, in which conductive material is directly filled into the via holes, such as metal of copper, gold, aluminum, nickel, but are not limited thereto.

The planar metal structures 520B may respectively belong to several metal layers in the substrate 310, and may have different patterns depending on the arrangements of the vertical radiator 510 and/or the vertical conductors 520A. As shown in FIG. 5A, in the embodiment, the lengths of the planar metal structures 520B are approximately the same, and the second lowermost planar metal structure 520B has a gap 526. In another embodiment, according to various design requirements, the lengths of the planar metal structures 520B may be different, and the gap 526 may be in another planar metal structure 5206.

The radiator unit 400A further includes a grounding plate 528 connected to the lowermost planar metal structure 520B in the reflective structure 520. The grounding plate 528 tapers in a direction from the planar metal structures 520B toward the vertical radiator 510, and a gap is between the grounding plate 528 and the vertical radiator 510 for impedance matching. As shown FIG. 5A, in the embodiment, the grounding plate 528 and the lowermost planar metal structure 520B are coplanar, i.e. belong to the same metal layer in the substrate 310. In addition, the grounding plate 528 and the lowermost planar metal structure 520B may be a single structure. In another embodiment, according to design requirements, the grounding plate 528 and the planar metal structure in the reflective structure 520 other than the lowermost planar metal structure 520B belong to the same metal layer in the substrate 310, or alternatively the grounding plate 528 may not be coplanar with each of the planar metal structures 520B in the reflective structure 520. The pattern of the grounding plate 528 shown in FIG. 5A is planar trapezoidal, while in another embodiment, the grounding plate 528 may have another tapered pattern.

The reflective structure 520 is divided into a first portion 522 and a second portion 524, of which the extending directions are non-parallel. In the embodiment, an end of the first portion 522 is connected with an end of the second portion 524 to form an L-shaped planar pattern, the extending direction of the first portion 522 is approximately perpendicular to the corresponding side edge of the substrate 310, and the extending direction of the second portion 524 is approximately parallel to the corresponding side edge of the substrate 310. In another embodiment, the angle between the extending directions of the first portion 522 and the second portion 524 may be an obtuse angle or an acute angle. In addition, as shown in FIG. 5A, the gap 526 is in the second portion 524, and the grounding plate 528 is connected with the second portion 524. The second portion 524 is used to reflect the radiation wave generated by the vertical radiator 510, such that the electromagnetic field radiates outwardly from the corresponding side edge of the substrate 310.

The horizontal metal branch 530 is coupled to the other end of the first portion 522 and is structurally separated from the grounding plate 528. As shown in FIG. 5A, in the embodiment, the horizontal metal branch 530 and the uppermost planar metal structure 520B are coplanar, i.e. belong to the same metal in the substrate 310, and the extending direction of horizontal metal branch 530 is approximately parallel to the extending direction of the second portion 524. In addition, the horizontal metal branch 530 and the uppermost planar metal structure 520B may be a single structure. The horizontal metal branch 530 may be a strip metal structure, of which the resonant length is approximately ¼ of the equivalent wavelength of the electromagnetic wave in the substrate 310, so as to increase the radiation component of the horizontal polarization. In another embodiment, according to design requirements, the horizontal metal branch 530 and the planar metal structure in the reflective structure 520 other than the uppermost planar metal structure 520B belong to the same metal layer in the substrate 310, or alternatively the horizontal metal branch 530 may not be coplanar with each of the planar metal structures 520B in the reflective structure 520. In FIG. 5, the horizontal metal branch 530 and the grounding plate 528 are respectively coplanar with the uppermost and lowermost planar metal structures 520B to further avoid parasitic effect.

The feeding trace 540 is coupled to the vertical radiator 510 and laterally penetrates through the reflective structure 520, such that the vertical radiator 510 is electrically coupled to the components in the center area 310 through the feeding trace 540. The feeding trace 540 and the planar metal structure 520B with the gap 526 may belong to the same metal layer in the substrate 310, and the feeding trace 540 extends from the vertical radiator 510 to the center area 310A and penetrates through the gap 526. The feeding trace 540 may be a parallel microstrip line structure or another transmission line structure.

Figure 6A:
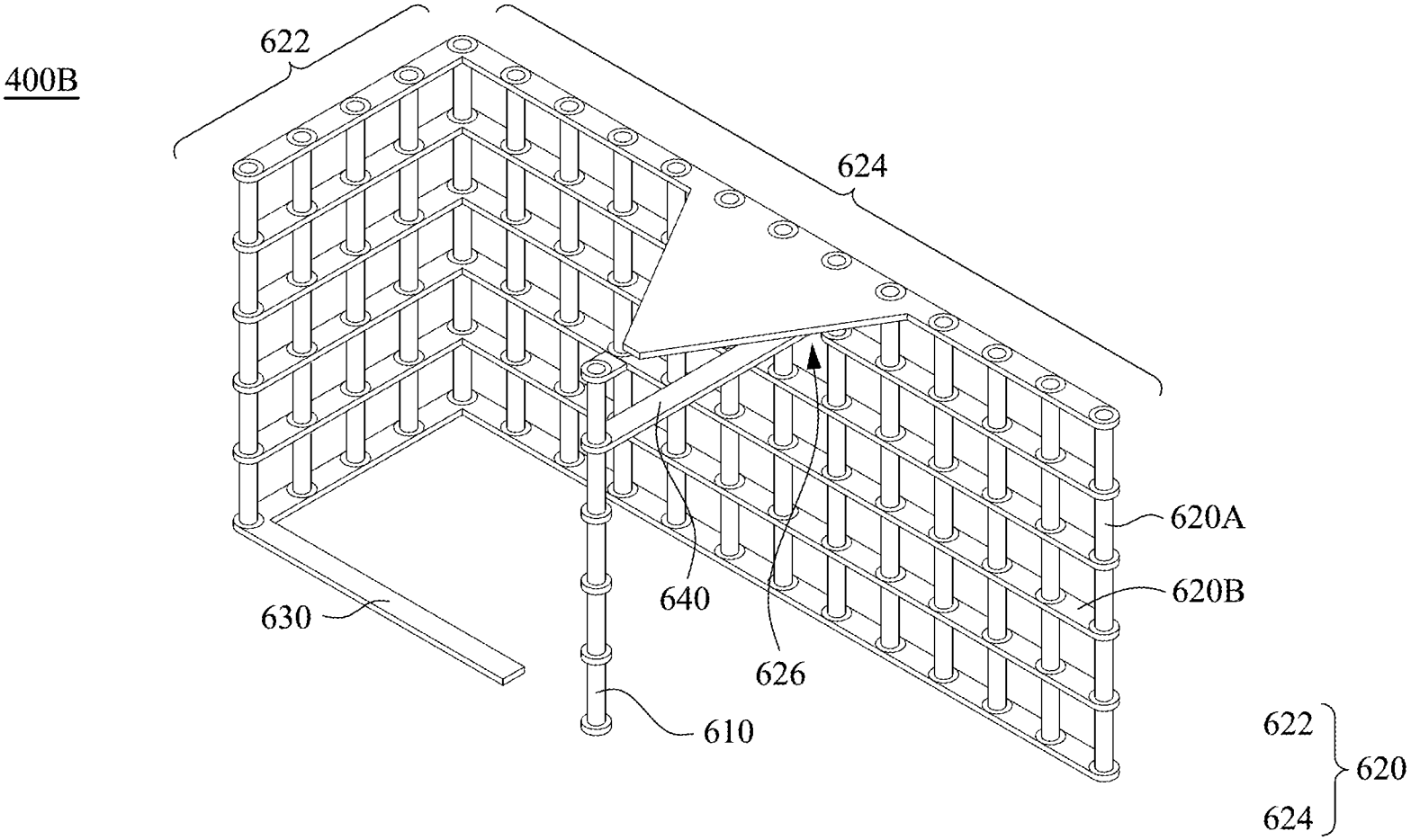
FIG. 6A and FIG. 6B are respectively a perspective view and a top view of the radiator unit in FIG. 4.
Figure 6B:
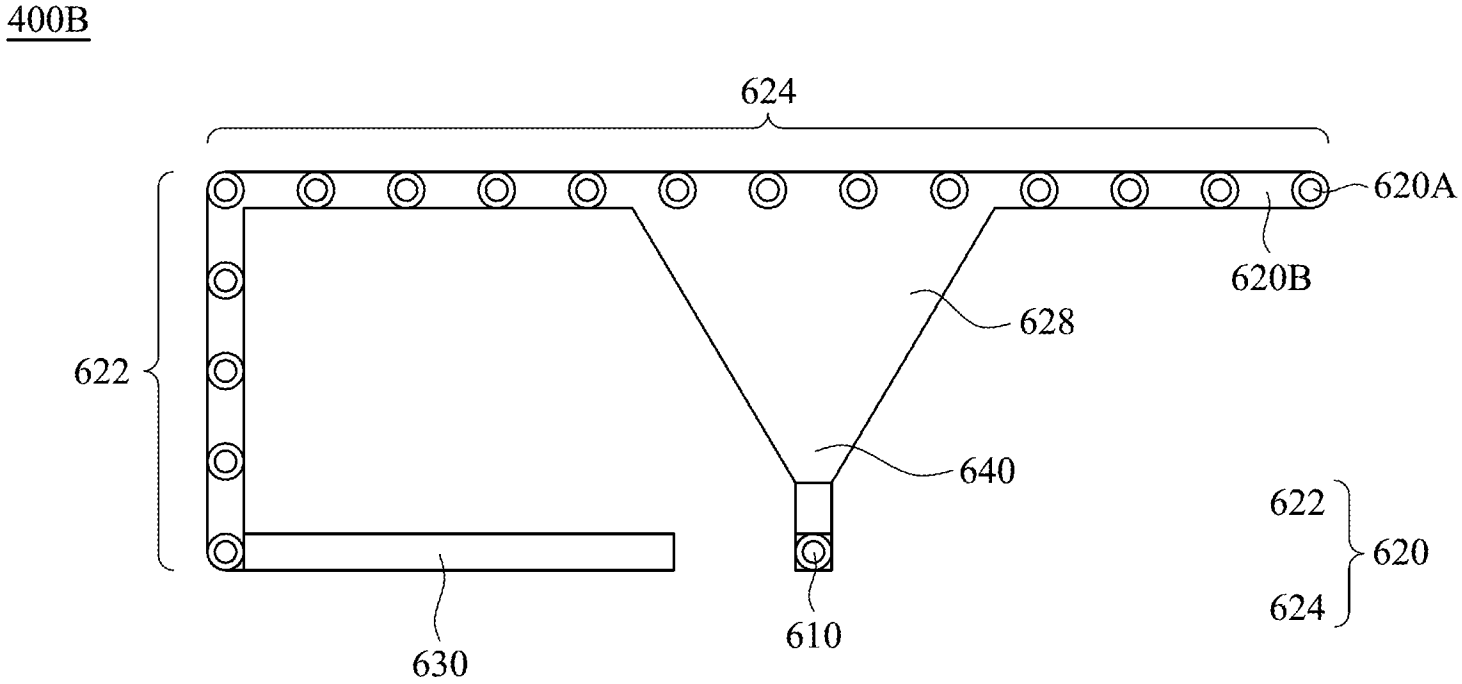

FIG. 6A and FIG. 6B are respectively a perspective view and a top view of the radiator unit 400B in FIG. 4. The radiator unit 400B includes a vertical radiator 610, a reflective structure 620, a horizontal metal branch 630 and a feeding trace 640, in which the vertical radiator 610 is coupled to the feeding trace 640, while the reflective structure 620 is laterally disposed external to the vertical radiator 610 and is coupled to the horizontal metal branch 630.

Similarly to the reflective structure 520 shown in FIG. 5A, the reflective structure 620 has a vertical conductor 620A and planar metal structures 620B and is divided into a first portion 622 and a second portion 624, in which the gap 626 penetrated through by the feeding trace 640 is in one of the planar metal structures 620B, while the grounding plate 628 is connected with another planar metal structure 620B. The functions of components in the radiator unit 400B may be respectively similar to those of the components in the radiator unit 400A, and therefore the related description can be referred to the foregoing paragraphs and is not repeated herein.

In the embodiment, the three-dimensional patterns of the radiator units 400A, 400B are upside down with respect to each other. In addition, the grounding plate 528 in the radiator unit 400A and the grounding plate 628 in the radiator unit 400B belong to different metal layers, and the horizontal metal branch 530 of the radiator unit 400A and the horizontal metal branch 630 of the radiator unit 400B also belong to different metal layers. In another embodiment, according to design requirements, the radiator unit 400A and/or the radiator unit 400B may have a three-dimensional pattern different from that shown in FIG. 5A and/or FIG. 6A, and the three-dimensional patterns of the radiator unit 400A, 400B may not be upside down with respect to each other. For example, the number of the vertical conductors 520A in the reflective structure 520 may be different from the number of the vertical conductors 620A in the reflective structure 620, the distance between the vertical radiator 610 and the first portion 622 may be less than the distance between the vertical radiator 510 and the first portion 522, and the grounding plate 628 and the planar metal structure in the reflective structure 620 other than the uppermost planar metal structure 620B may belong to the same metal layer in the substrate 310.

As shown in FIG. 4, FIG. 5A and FIG. 6A, the vertical radiator 510 of the radiator unit 400A and the vertical radiator 610 of the radiator unit 400B neighboring the radiator unit 400A are spaced from each other, and the reflective structure 520 of the radiator unit 400A and the reflective structure 620 of the radiator unit 400B neighboring the radiator unit 400A are coupled to each other. Specifically, the first portion 522 of the reflective structure 520 and the first portion 622 of the reflective structure 620 are respectively at a side edge of the radiator set 400 and at the boundary between the two neighboring radiator units 400A, 400B, such that the vertical radiators 510, 610 in the two neighboring radiator units 400A, 400B are spaced from each other, and the second portion 524 of the reflective structure 520 and the second portion 624 of the reflective structure 620 are connected with each other to form a wall shape. In addition, each radiator unit 400A/400B includes the vertical radiator 510/610, and thus in the radiator set 400, the grounding plate 528/628 and the horizontal metal branch 530/630, the grounding plates 528/628 are respectively associated with the vertical radiators 510/610, and the horizontal metal branches 530/630 are also respectively associated with the vertical radiators 510/610.

In the embodiment of which the planar metal structures 620B in the radiator unit 400B and the planar metal structures 520B in the radiator unit 400A are coplanar, as shown in FIG. 4, the uppermost planar metal structure 520B in the radiator unit 400A and the uppermost planar metal structure 620B in the radiator unit 400B are connected with each other, the lowermost planar metal structure 520B in the radiator unit 400A and the lowermost planar metal structure 620B in the radiator unit 400B are connected with each other, and the rightmost vertical conductor 520A/620A in the radiator unit 400A/400B is also the leftmost vertical conductor 620A/520A in the second portion 624/524 of the radiator unit 400B/400A neighboring the radiator unit 400A/400B. In addition, the combination of the first portion 522/622 and the horizontal metal branch 530/630 in the radiator unit 400A/400B is used for increasing the isolation between the radiator unit 400A/400B and the radiator unit 400B/400A at the left of the radiator unit 400A/400B, and the horizontal metal branch 530/630 is used for guiding the radio frequency current, so as to prevent the radio frequency current from coupling to the radiator unit 400B/400A that results in a center frequency shift of the radiator units 400A, 400B, and simultaneously a horizontal radio frequency current component may also be generated on the horizontal metal branch 530/630, such that the antenna has a horizontal polarization.

In another embodiment, the radiator units 400A, 400B in the substrate 310 may be vertically misaligned and/or horizontally misaligned. For example, the uppermost planar metal structure 520B in the radiator unit 400A may be connected with a planar metal structure other than the uppermost planar metal structure 620B in the radiator unit 400B, the whole or a part of the rightmost vertical conductor 520A/620A in the radiator unit 400A/400B may also be the whole or a part of a vertical conductor other than the outermost vertical conductor 620A/520A in the first portion 622/522 of the radiator unit 4006/400A at the right side of the radiator unit 400A/400B.

Figure 7:
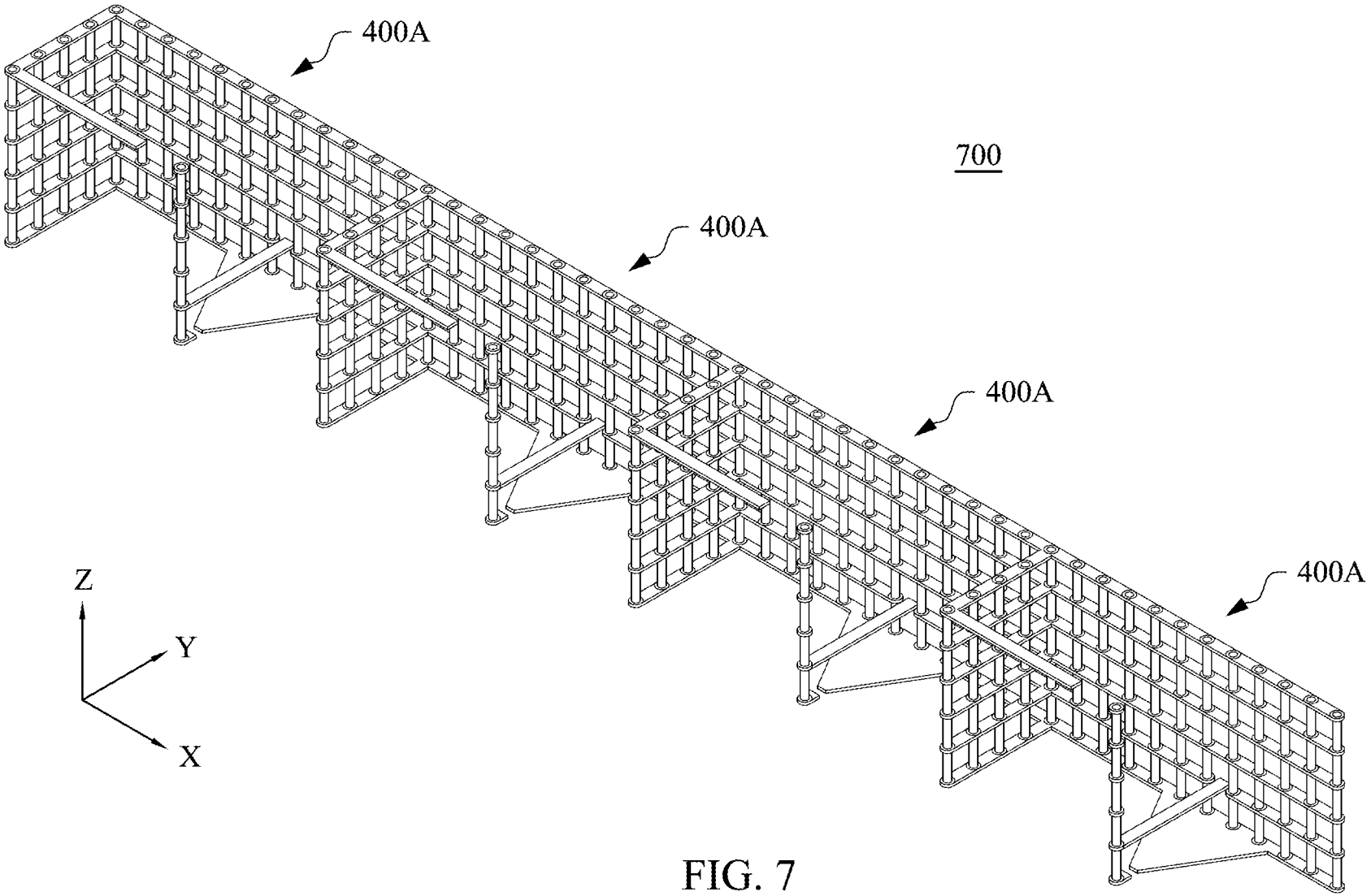
FIG. 7 is a perspective view of a radiator set 700 in accordance with some other embodiments of the invention.

FIG. 7 is a perspective view of a radiator set 700 in accordance with some other embodiments of the invention. As shown in FIG. 7, the radiator set 700 is formed of sequentially arranged radiator units 400A. As shown in FIG. 5A and FIG. 7, the vertical radiators 510 of the two neighboring radiator units 400A are spaced from each other, and the reflective structures 520 of the two neighboring radiator units 400A are coupled to each other. In particular, the first portions 522 of the reflective structures 520 are respectively at a side edge of the radiator set 400 and at the boundary between the two neighboring radiator units 400A, such that the vertical radiators 510 in the two neighboring radiator units 400A are spaced from each other, and the second portions 524 of the reflective structures 520 are connected with each other to form a wall shape. In addition, each radiator unit 400A has the vertical radiator 510, the grounding plate 528 and the horizontal metal branch 530, and thus in the radiator set 700, the grounding plates 528 are respectively associated with the vertical radiators 510, and the horizontal metal branches 530 are also respectively associated with the vertical radiators 510.

The planar metal structures 520B of the two neighboring radiator units 400A may be in a one-to-one correspondence. As shown in FIG. 7, the uppermost and lowermost planar metal structures 520B in the two neighboring radiator units 400A are respectively connected with each other, and the rightmost vertical conductor 520A in the left radiator unit 400A is also the leftmost vertical conductor 520A in the second portion 524 of the right radiator unit 400A neighboring the left radiator unit 400A. In addition, the combination of the first portion 522 and the horizontal metal branch 530 in the right radiator unit 400A is used for increasing the isolation between the left and right radiator units 400A, and the horizontal metal branch 530 is used for guiding the radio frequency current, so as to prevent the radio frequency current from coupling to the left radiator unit 400A that results in a center frequency shift of the left and right radiator units 400A, and simultaneously a horizontal radio frequency current component may also be generated on the horizontal metal branch 530, such that the antenna has a horizontal polarization.

In another embodiment, the two neighboring radiator units 400A in the substrate 310 may be vertically misaligned and/or horizontally misaligned. For example, the uppermost planar metal structure 520B in the left radiator unit 400A may be connected with a planar metal structure other than the uppermost planar metal structure 520B in the right radiator unit 400A, and the whole or a part of the rightmost vertical conductors 520A in the left radiator unit 400A may also be the whole or a part of a vertical conductor other than the outermost vertical conductor 520A in the first portion 522 of the right radiator unit 400A.

In another embodiment, the radiator set 700 may be formed of sequentially arranged radiator units 400B, which is similar to sequentially arranged radiator units 400A, and therefore the related description can be referred to the foregoing paragraphs and is not repeated herein.

FIG. 7 is exemplified as the radiator set 700 arranged in the area 312 of the antenna structure 300. In various embodiments, the radiator set 700 may be disposed in each of the areas 312, 314, 316, 318 of the antenna structure 300. In addition, in some embodiments, according to design requirements, the radiator set 400 or the radiator set 700 may be selectively disposed in each of the areas 312, 314, 316, 318 of the antenna structure 300. For example, the radiator set 400 may be disposed in each of the areas 312, 316, and the radiator set 700 may be disposed in each of the areas 314, 318.

Figure 8:
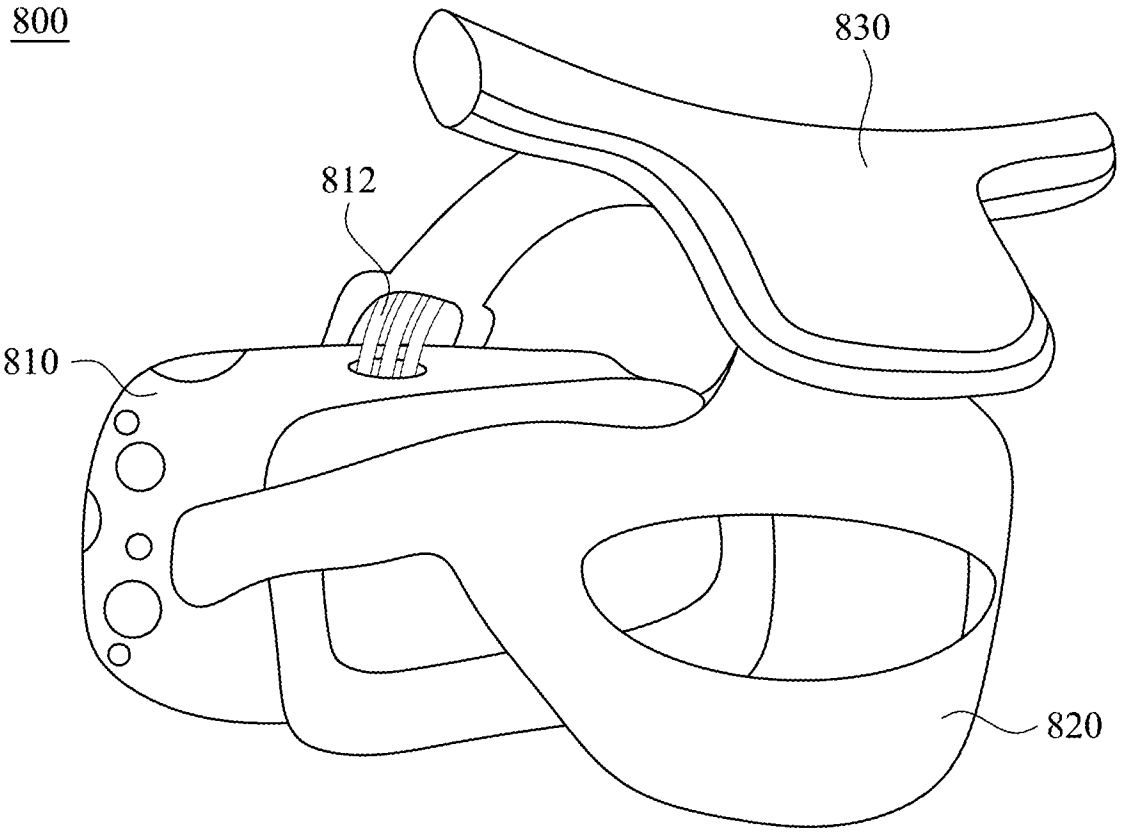
FIG. 8 is an illustrative example of an electronic apparatus.

The antenna structure in accordance with embodiments of the invention may be applied to may electronic products with wireless communication functions. FIG. 8 is an illustrative example of an electronic apparatus. In the illustrative example of FIG. 8, an electronic apparatus 800 include a main body 810, a wearable article 820 and a wireless communication module 830. The main body 810 includes components such as display panels and a processor, while the wearable article 820 is provided for a user to wear the electronic apparatus 800 on his head. After the user wears the electronic apparatus 800 on his head, the display panels in the main body 810 will be at front of the user's eyes and display an image corresponding to the computation of the processor. The wearable article 820 may be elastic, and/or the length of the wearable article 820 is adjustable. In some embodiments, the wearable article 820 may be removed from the main body 810. The wireless communication module 830 has an antenna structure and can be mounted on the wearable article 820, and can be connected to the main body 810 through a transmission line 812 for providing wireless communication functions for the main body 810. That is, the main body 810 can perform data transmission and reception with an entity having wireless communication functions through the wireless communication module 830. In another embodiment, the wireless communication module 830 may be communicatively connected with the main body 810 in a wireless manner.

Figure 9:
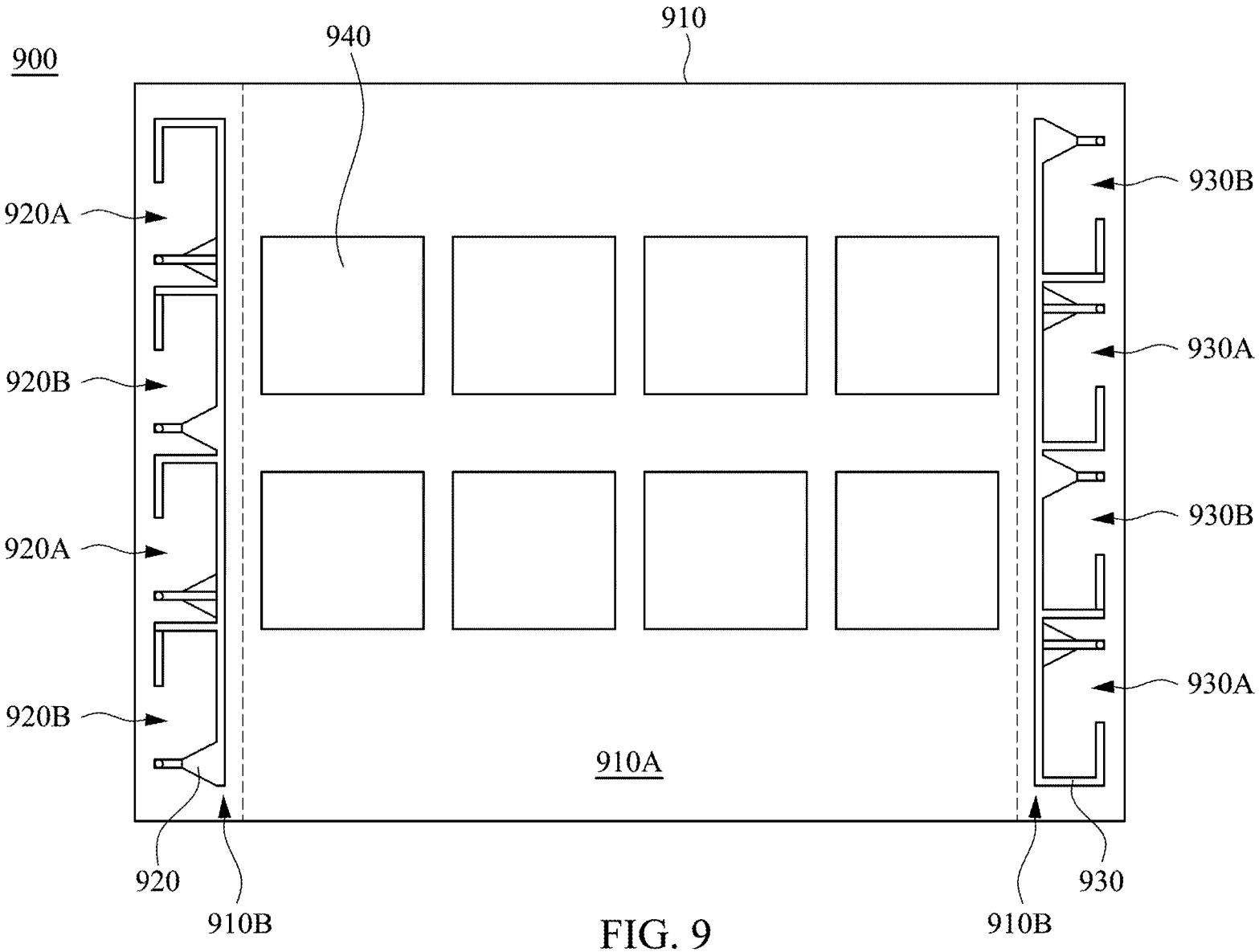
FIG. 9 is an implementation of the antenna structure of the wireless communication module in FIG. 8.

FIG. 9 is an implementation of the antenna structure of the wireless communication module 830 in FIG. 8. As shown in FIG. 9, an antenna structure 900 includes a substrate 910, radiator sets 920, 930 and a phased array radiator 940. The radiator sets 920, 930 are disposed in a peripheral area 910B of the substrate 910 and respectively at two opposite side edges of the substrate 910, so as to generate side omnidirectional dual-polarized beams on the side surfaces of the substrate 910. The radiator set 920 is formed of alternately arranged and connected radiator units 920A, 920B, and the radiator set 930 is formed of alternately arranged and connected radiator units 930A, 930B. Each three-dimensional pattern of the radiator units 920, 930 may be the same as the three-dimensional pattern of the radiator set 400 shown in FIG. 4. That is, each of the radiator units 920A, 930A may be the radiator unit 400A shown in FIG. 5A and FIG. 5B, and each of the radiator units 920B, 930B may be the radiator unit 400B shown in FIG. 6A and FIG. 6B. The phased array radiator 940 is disposed in a center area 910A of the substrate 910 and may be on the top surface of the substrate 910, so as to generate multi-beam arrays with angles with respect to the planar direction of the substrate 910.

In the illustration, the radiator sets 920, 930 in the substrate 910 are point-symmetric with respect to each other, i.e., the 180-degree rotation of the three-dimensional pattern of the radiator set 920 in the horizontal direction of the substrate 910 is the same as the three-dimensional pattern of the radiator set 930. In another illustration, the radiator sets 920, 930 in the substrate 910 may be line-symmetric with respect to each other, i.e., the three-dimensional pattern of the radiator set 920 is a mirror of the three-dimensional pattern of the radiator set 930.

Figure 10:
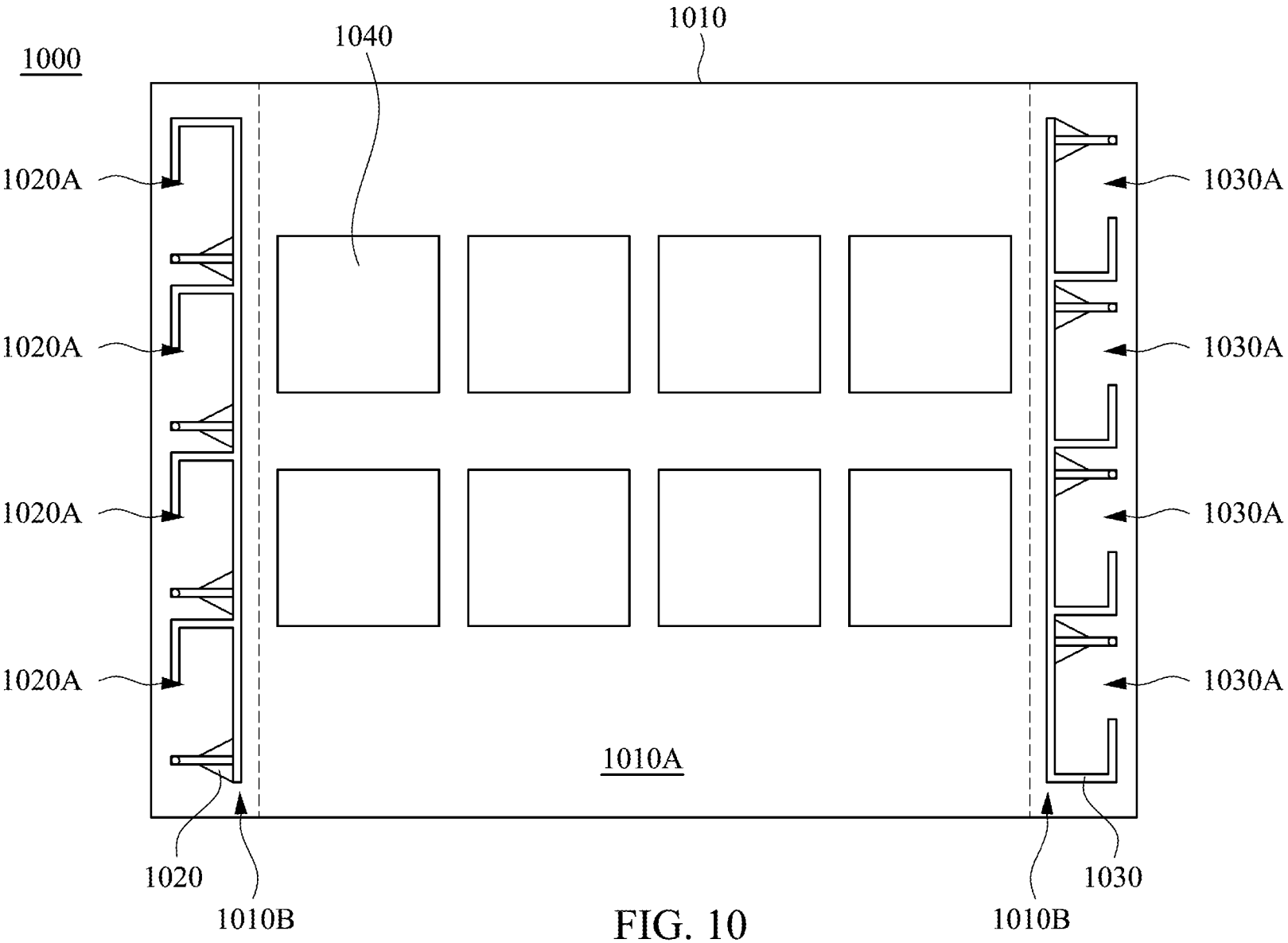
FIG. 10 is another implementation of the antenna structure of the wireless communication module in FIG. 8.

FIG. 10 is another implementation of the antenna structure of the wireless communication module 830 in FIG. 8. As shown in FIG. 10, an antenna structure 1000 includes a substrate 1010, radiator sets 1020, 1030 and a phased array radiator 1040. The radiator sets 1020, 1030 are disposed in a peripheral area 1010B of the substrate 1010 and respectively at two opposite side edges of the substrate 1010, so as to generate side omnidirectional dual-polarized beams on the side surfaces of the substrate 1010. The radiator set 1020 is formed of connectively arranged radiator units 1020A, and the radiator set 1030 is formed of connectively arranged radiator units 1030A. Each three-dimensional pattern of the radiator sets 1020, 1030 may be the same as the three-dimensional pattern of the radiator set 700 shown in FIG. 7. That is, each of the radiator units 1020A, 1030A may be the radiator unit 400A shown in FIG. 5A and FIG. 5B. The phased array radiator 1040 is disposed in the center area 1010A of the substrate 1010 and on the top surface of the substrate 1010, so as to generate multi-beam arrays with angles with respect to the planar direction of the substrate 1010.

In another example, the radiator sets 1020, 1030 may have different three-dimensional patterns. For example, each radiator unit 1020A may be the radiator unit 400A shown in FIG. 5A and FIG. 5B, while each radiator unit 1030A may be the radiator unit 400B shown in FIG. 6A and FIG. 6B.

Figure 11:
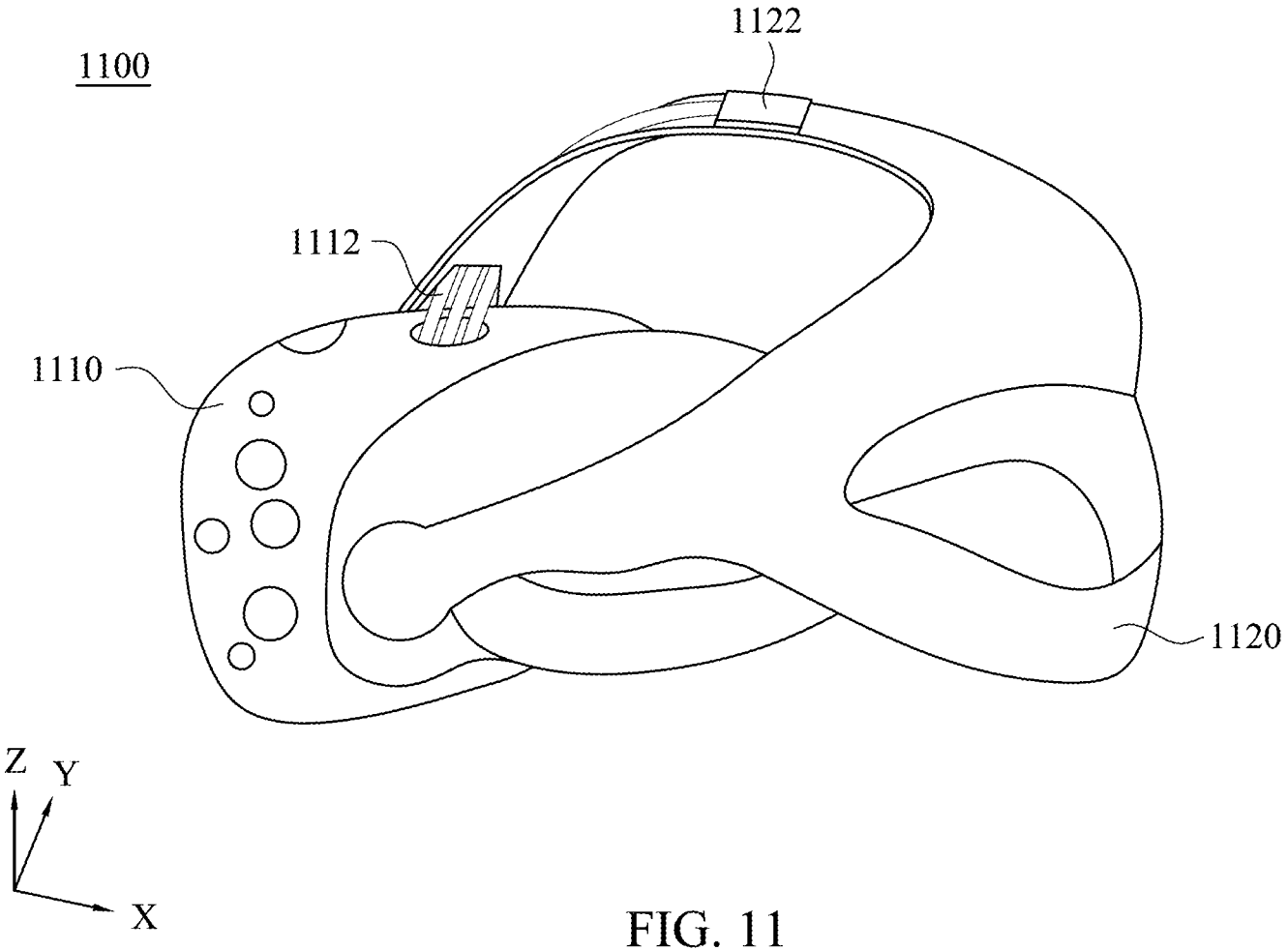
FIG. 11 is another illustrative example of an electronic apparatus.

FIG. 11 is another illustrative example of an electronic apparatus. In the illustrative example of FIG. 11, an electronic apparatus 1100 includes a main body 1110 and a wearable article 1120. The main body 1110 is similar to the main body 810 of the electronic apparatus 800, and therefore the description thereof can be referred to the foregoing paragraphs and is not repeated herein. the wearable article 1120 may also be elastic, and/or the length of the wearable article 1120 is adjustable. In some embodiments, the wearable article 1120 may also be removed from the main body 1110. An antenna structure 1122 is further disposed at the top of the wearable article 1120, and can be connected to the main body 1110 through a transmission line 1112 and another component (not shown) for providing wireless communication functions for the main body 1110. That is, the main body 1110 can perform data transmission and reception with an entity having wireless communication functions through the antenna structure 1122. For artistic demands of the electronic apparatus 1100, the antenna structure 1122 may be enclosed by the wearable article 1120.

Figure 12:
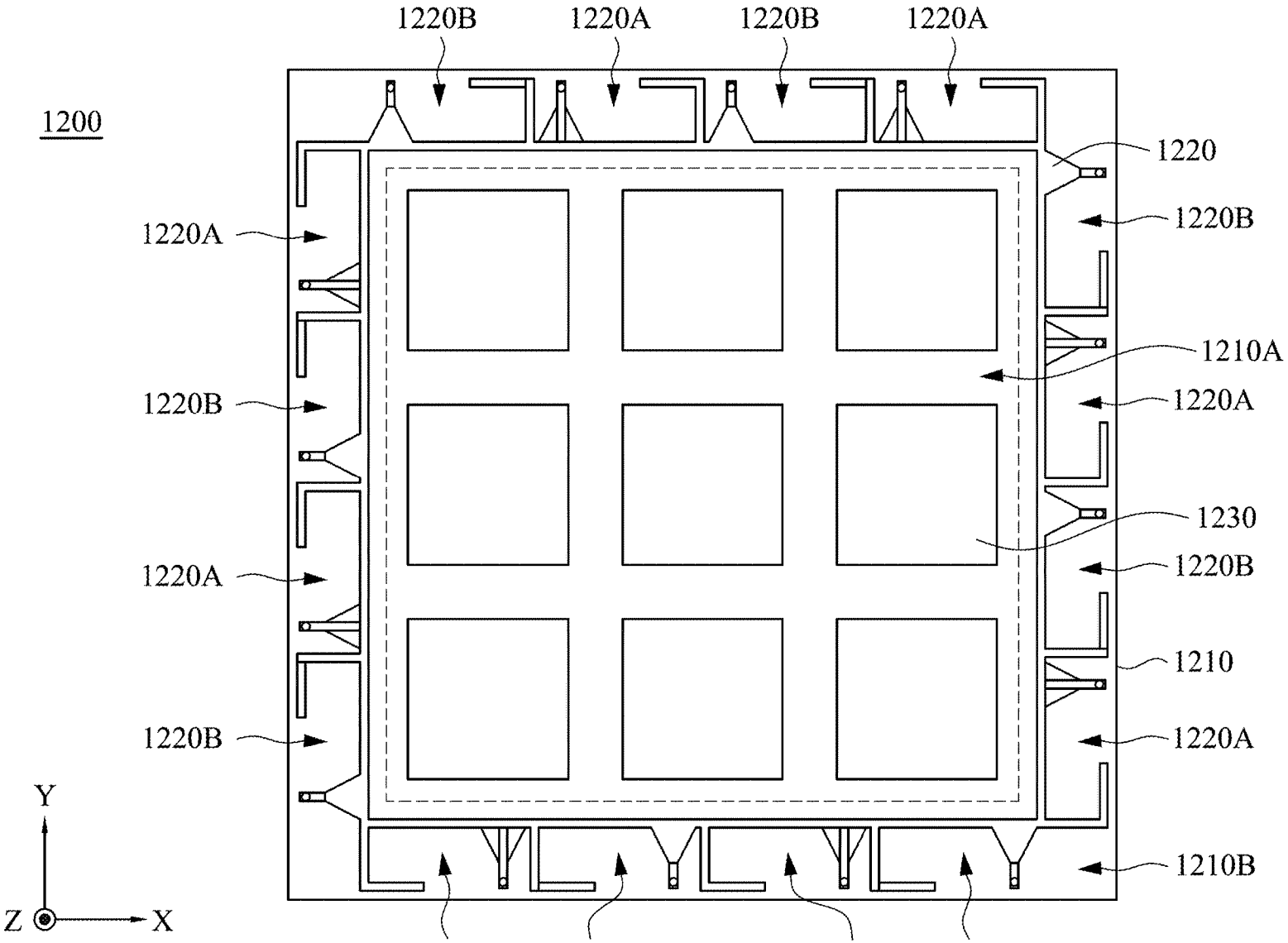
FIG. 12 is a simplified top view of an antenna structure in accordance with some embodiments of the invention.

FIG. 12 is a simplified top view of an antenna structure 1200 in accordance with some embodiments of the invention. As shown in FIG. 12, the antenna structure 1200 includes a substrate 1210, a radiator set 1220 and a phased array radiator 1230. The radiator set 1220 is disposed in a peripheral area 1210B of the substrate 1210 and surrounding a center area 1210A the substrate 1210, while the phased array radiator 1230 is disposed in the center area 1210A of the substrate 1210. The radiator set 1220 is formed of alternately and connectively arranged radiator units 1220A, 1220B. The radiator set 1220 has four branches respectively at four side edges of the substrate 1210, so as to generate side omnidirectional dual-polarized beams on the side surfaces of the substrate 1210. The three-dimensional pattern of each branch of the radiator set 1220 may be the same as the pattern of the radiator set 400 shown in FIG. 4. In the planar arrangement, the reflective structures in the radiator units 1220A, 1220B are connected with other to form a single reflective structure, and in this reflective structure, the second portions (corresponding to the second portion 524 shown in FIG. 5B and the second portion 624 shown in FIG. 6B) at the same side of the substrate 1210 are connected with each other to form a single second portion, and each first portion (corresponding to the first portion 522 shown in FIG. 5A and the first portion 622 shown in FIG. 6A) extends from the second portion connected thereto toward the nearest side edge of the substrate 1210. The phased array radiator 1230 may be on the top surface of the substrate 1210, so as to generate multi-beam arrays with angles with respect to the planar direction of the substrate 1210.

Figure 13:
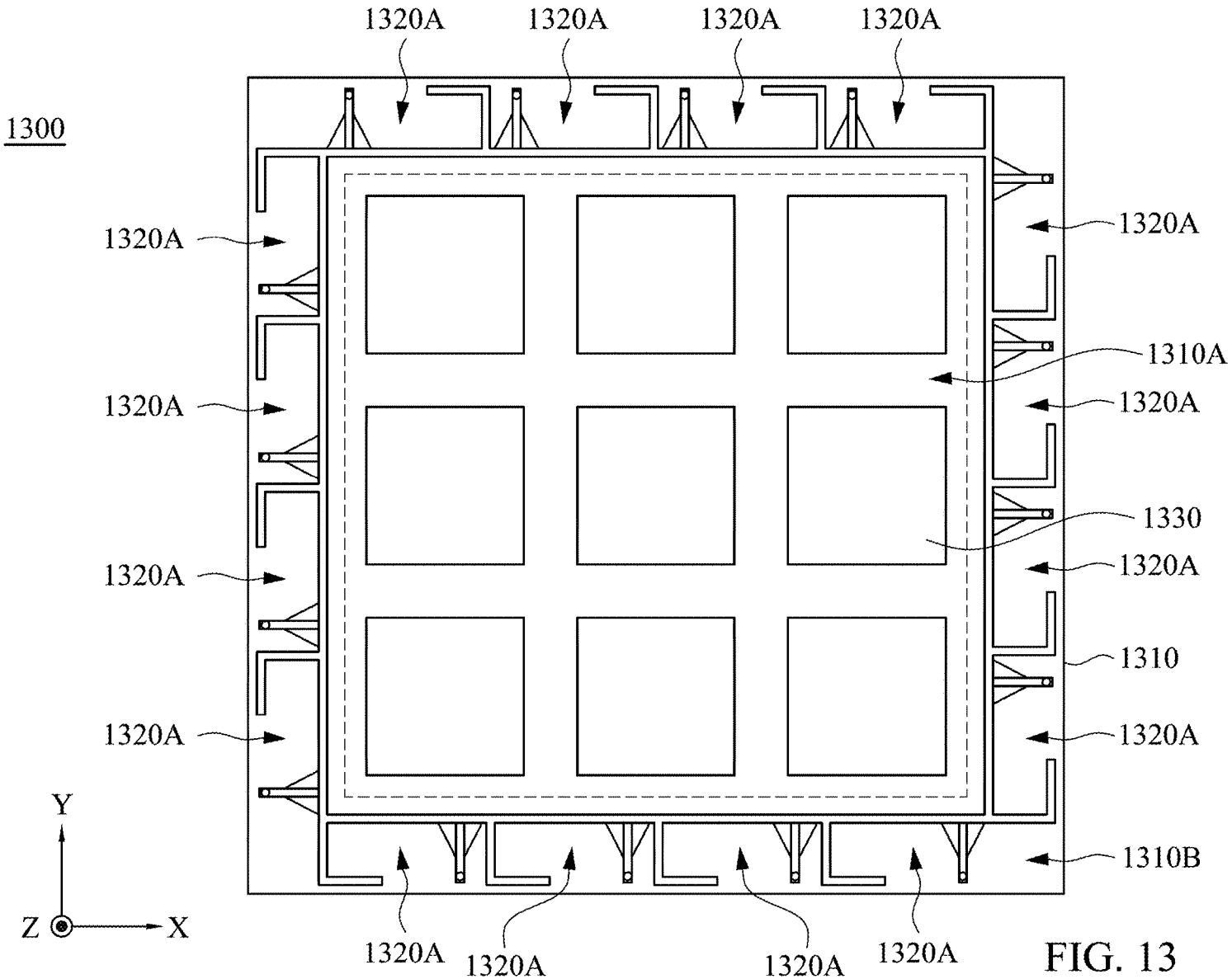
FIG. 13 is a simplified top view of an antenna structure in accordance with some embodiments of the invention.

FIG. 13 is a simplified top view of an antenna structure 1300 in accordance with some embodiments of the invention. As shown in FIG. 13, the antenna structure 1300 includes a substrate 1310, a radiator set 1320 and a phased array radiator 1330. The radiator set 1320 is disposed in a peripheral area 1310B of the substrate 1310 and surrounding the center area 1310A of the substrate 1310, while the phased array radiator 1330 is disposed in a center area 1310A of the substrate 1310. In comparison with the antenna structure 1200 in FIG. 12, in the antenna structure 1300 in FIG. 13, the radiator set 1320 is formed of connectively arranged radiator units 1320A. Similarly, the radiator set 1320 has four branches respectively at four side edges of the substrate 1310, so as to generate side omnidirectional dual-polarized beams on the side surfaces of the substrate 1310, and the three-dimensional pattern of each branch of the radiator set 1320 may be the same as the pattern of the radiator set 700 shown in FIG. 7. In addition, the planar arrangement of the radiator set 1320 in the substrate 1310 may also be similar to that of the radiator set 1220 in the substrate 1210. The other components in the antenna structure 1300 are respectively the same as the corresponding components of the antenna structure 1200 in FIG. 12, and therefore the related description can be referred to the foregoing paragraphs and is not repeated herein.

According to the antenna structures 1200, 1300 shown in FIG. 12 and FIG. 13, in addition to generating normal beams on the top surfaces, the antenna structures 1200, 1300 also generate polarized beams with side omni-directional radiation patterns.

In some embodiments, the antenna structure 1122 in FIG. 11 may be implemented as the antenna structure 1200 shown in FIG. 12 or the antenna structure 1300 shown in FIG. 13, in which the antenna structure 1122 is horizontally disposed in the wearable article 1120, and the phased array radiator is toward the above of the electronic apparatus 1100. As such, when the electronic apparatus 1100 is worn on a user's head, the wireless communication between the electronic apparatus 1100 and another entity is not easily affected by the user's particular poses, so as to improve user experience.

Figure 14A:
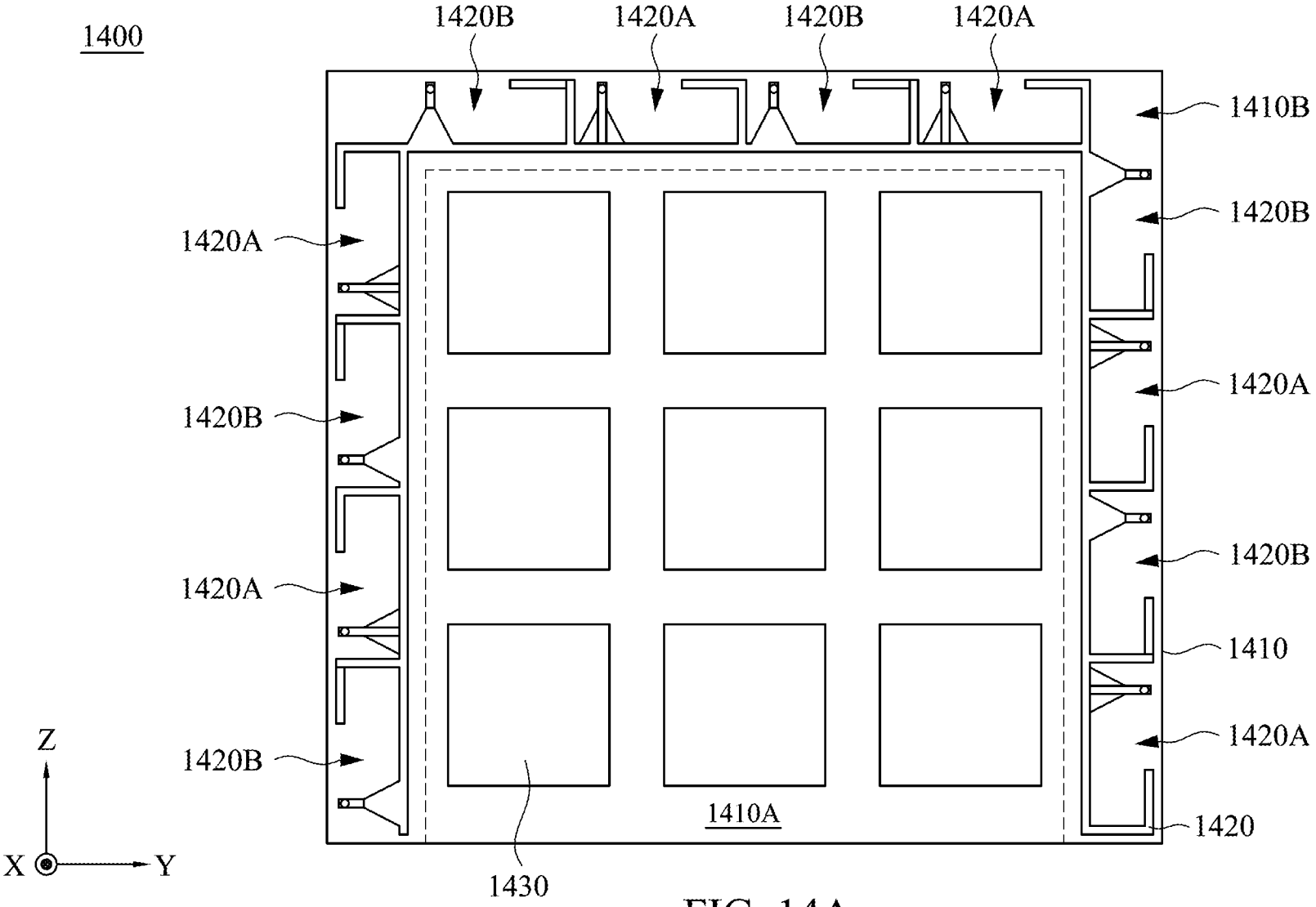
FIG. 14A and FIG. 14B are respectively simplified views of two opposite sides of an antenna structure in accordance with some embodiments of the invention.
Figure 14B:
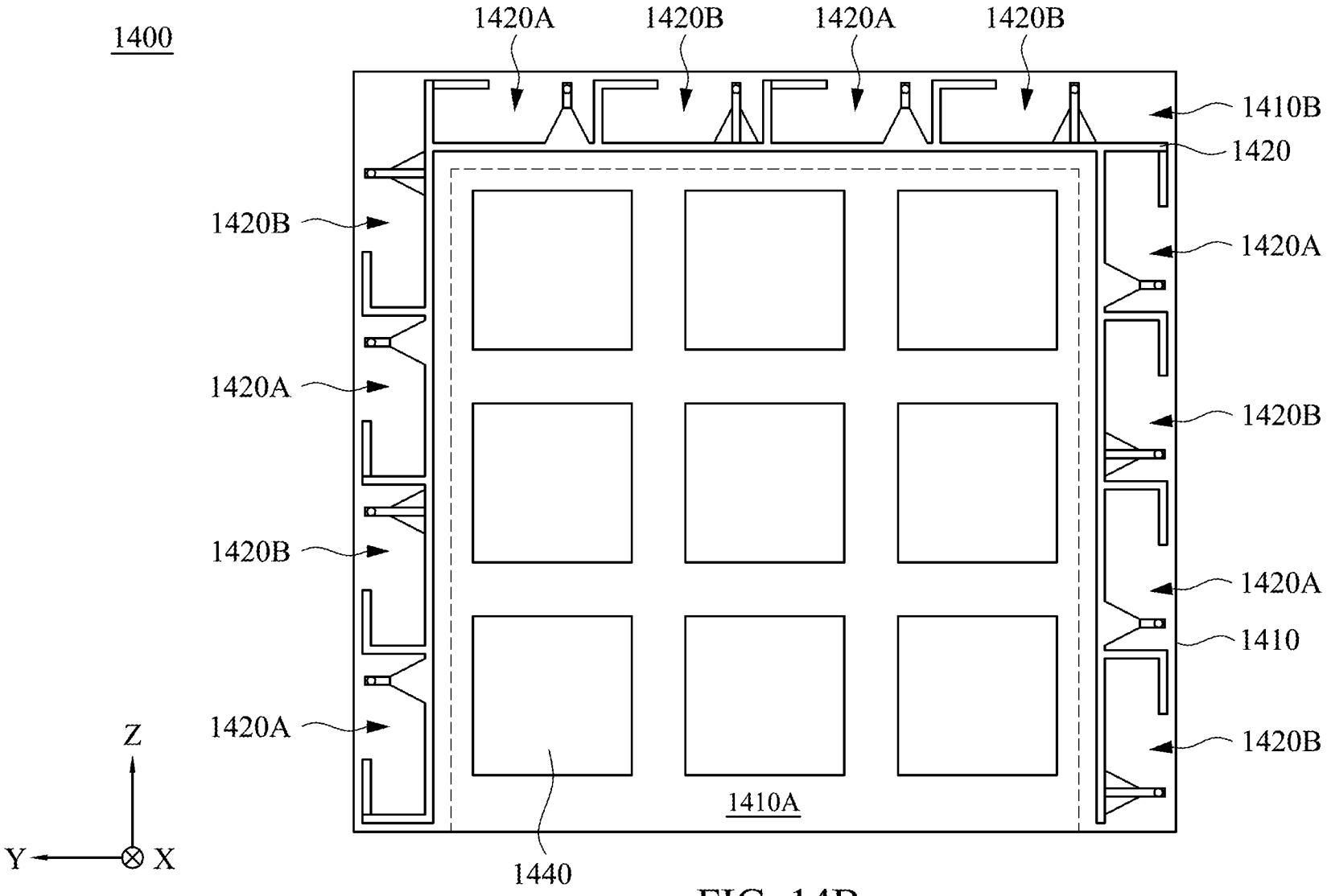

FIG. 14A and FIG. 14B are respectively simplified views of two opposite sides of an antenna structure 1400 in accordance with some embodiments of the invention. As shown in FIG. 14A and FIG. 14B, the antenna structure 1400 includes a substrate 1410, a radiator set 1420 and phased array radiators 1430, 1440. The radiator set 1420 is disposed in a peripheral area 1410B of the substrate 1410 and is formed of alternately arranged and connected radiator units 1420A, 1420B, while the phased array radiators 1430, 1440 are all disposed in a center area 1410A of the substrate 1410. The radiator set 1420 has three branches respectively at three side faces of the substrate 1410, so as to generate side omnidirectional dual-polarized beams on three side surfaces of the substrate 1410. The three-dimensional pattern of each branch of the radiator set 1420 may be the same as the pattern of the radiator set 400 shown in FIG. 4. In the planar arrangement, the reflective structures in the radiator units 1420A, 1420B are connected with each other to form a single reflective structure, an in this reflective structure, the second portions (corresponding to the second portion 524 shown in FIG. 5B and the second portion 624 shown in FIG. 6B) at the same side edge of the substrate 1410 are connected with each other to form a single second portion, and each first portion (corresponding to the first portion 522 shown in FIG. 5A and the first portion 622 shown in FIG. 6A) extends from the second portion connected thereto toward the nearest side edge of the substrate 1410. The phased array radiators 1430, 1440 are respectively on the two relative principal surfaces of the substrate 1410, so as to generate multi-beam arrays with angles with respect to the planar direction of the substrate 1410 at the relative two sides of the substrate 1410.

Figure 15A:
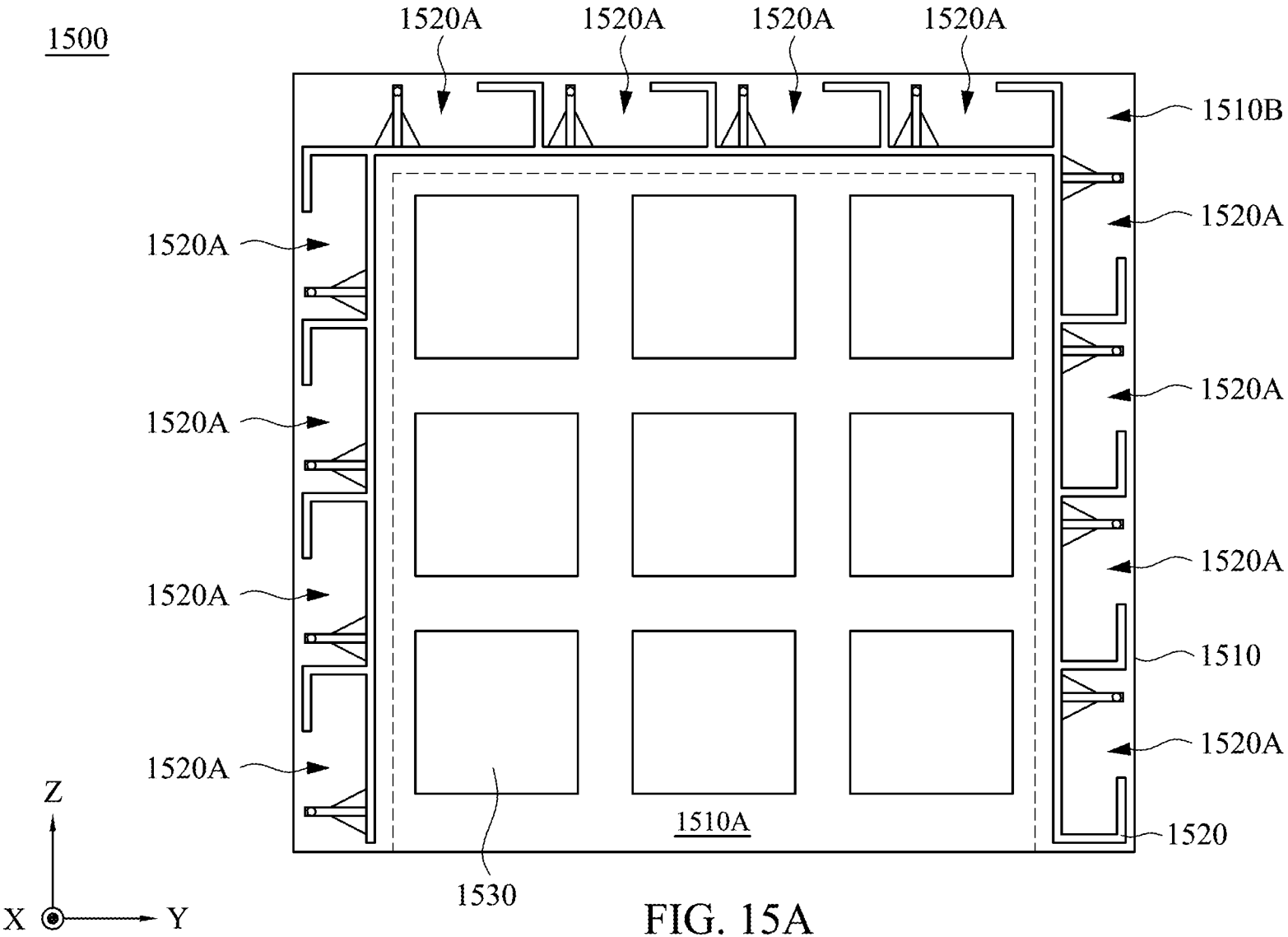
FIG. 15A and FIG. 15B are respectively simplified views of two opposite sides of an antenna structure in accordance with some embodiments of the invention.
Figure 15B:
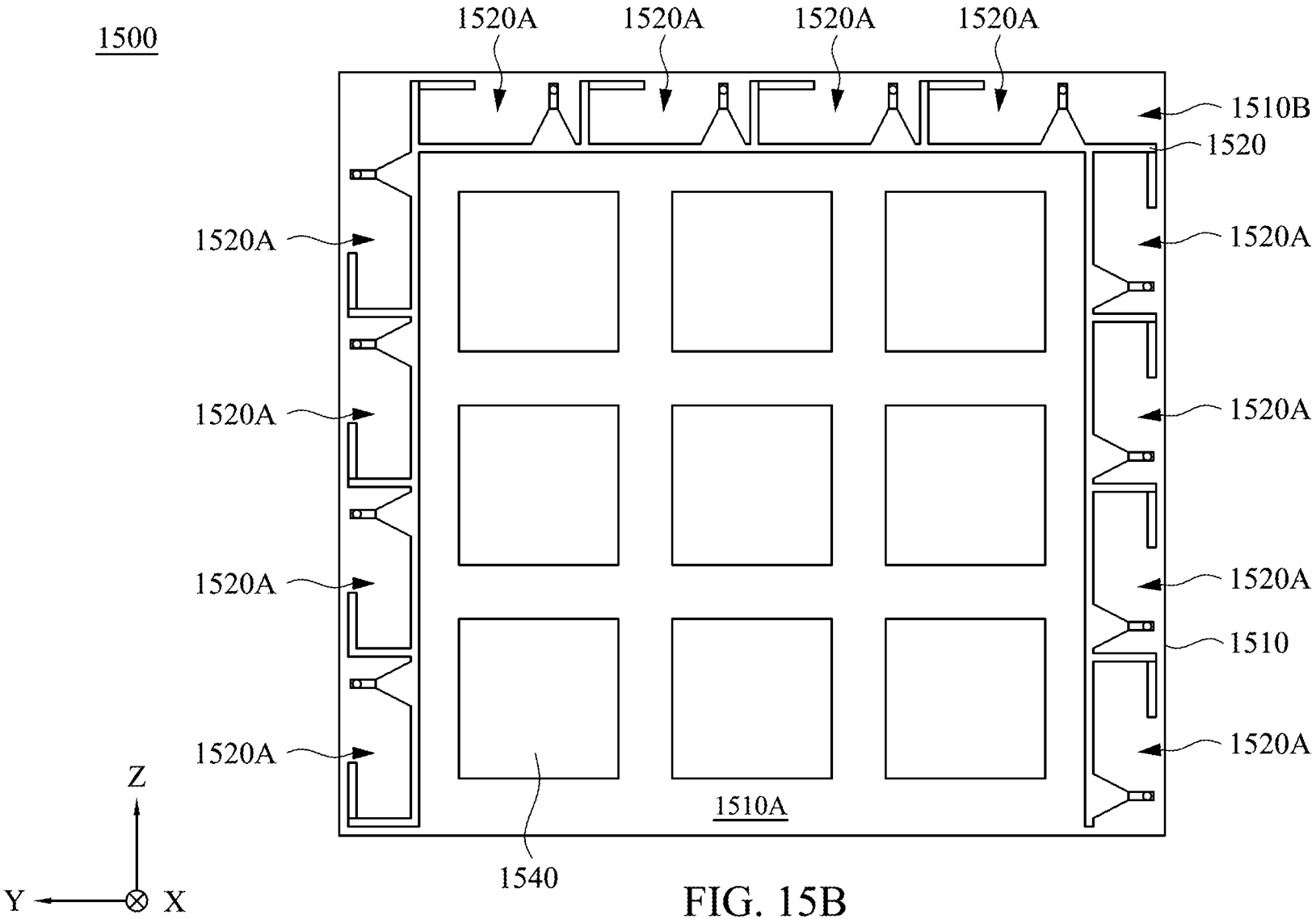

FIG. 15A and FIG. 15B are respectively simplified views of two opposite sides of an antenna structure 1500 in accordance with some embodiments of the invention. As shown in FIG. 15A and FIG. 15B, the antenna structure 1500 includes a substrate 1510, a radiator set 1520 and phased array radiators 1530, 1540. The radiator set 1520 is disposed in a peripheral area 1510B of the substrate 1510, while the phased array radiators 1530, 1540 are all disposed in a center area 1510A of the substrate 1510. In comparison with the antenna structure 1400 in FIG. 14A and FIG. 14B, in the antenna structure 1500 in FIG. 15A and FIG. 15B, the radiator set 1520 is formed of connectively arranged radiator units 1520A. Similarly, the radiator set 1520 has three branches respectively at three side edge of the substrate 1510, so as to generate side omnidirectional dual-polarized beams on three side surfaces of the substrate 1510, and the three-dimensional pattern of each branch of the radiator set 1520 may be the same as the pattern of the radiator set 700 shown in FIG. 7. In addition, the planar arrangement of the radiator set 1520 in the substrate 1510 may also be similar to that of the radiator set 1420 in the substrate 1410. The other components in the antenna structure 1500 are respectively the same as the corresponding components in the antenna structure 1400 of FIG. 14A and FIG. 14B, and therefore the related description can be referred to the foregoing paragraphs and is not repeated herein.

According to the antenna structures 1400, 1500 shown in FIG. 14A to FIG. 15B, in addition to generating normal beams on the two relative principal surfaces, the antenna structure 1400, 1500 also generate dual-polarized beams on their side surfaces with a radiation pattern covering range over 270 degree. As such, the antenna structures 1400, 1500 have quasi omni-directional coverages.

In some embodiments, the antenna structure 1122 in FIG. 11 may be implemented as the antenna structure 1400 shown in FIG. 14A and FIG. 14B or the antenna structure 1500 shown in FIG. 15A and FIG. 15B, in which the antenna structure 1122 is vertically disposed in the wearable article 1120, the phased array radiators are respectively toward the left and right sides of the electronic apparatus 1100, and the side edge without an radiator unit is toward the lower side of the electronic apparatus 1100. As such, when the electronic apparatus 1100 is mounted on a user's head, the wireless communication between the electronic apparatus 1100 and another entity is not easily affected by the user's particular poses, so as to improve user experience.

Although the invention is described above by means of the implementation manners, the above description is not intended to limit the invention. A person of ordinary skill in the art can make various variations and modifications without departing from the spirit and scope of the invention, and therefore, the protection scope of the invention is as defined in the appended claims.

What is claimed is:

1. An antenna structure, comprising:

a substrate;

a vertical radiator in the substrate;

a reflective structure laterally disposed external to the vertical radiator;

a horizontal metal branch coupled to the reflective structure; and a grounding plate coupled to the reflective structure and structurally separated from the horizontal metal branch.

2. The antenna structure of claim 1, wherein the reflective structure has a first portion and a second portion, wherein an extending direction of the first portion is non-parallel with an extending direction of the second portion.

3. The antenna structure of claim 2, wherein the horizontal metal branch is coupled to an end of the first portion of the reflective structure.

4. The antenna structure of claim 1, wherein the horizontal metal branch is a strip metal structure, of which an extending direction is substantially parallel to the extending direction of the second portion of the reflective structure.

5. The antenna structure of claim 1, wherein the grounding plate tapers in a direction toward the vertical radiator.

6. The antenna structure of claim 1, wherein the vertical radiator is a conductive via structure.

7. The antenna structure of claim 1, wherein the vertical radiator, the reflective structure and the horizontal metal branch are at a side edge of the substrate.

8. The antenna structure of claim 1, further comprising:

a feeding trace coupled to the vertical radiator and laterally penetrating through the reflective structure.

9. An antenna structure, comprising:

a substrate; and a plurality of radiator units in the substrate, each of the radiator units comprising:

a vertical radiator;

a reflective structure laterally disposed external to the vertical radiator; and a horizontal metal branch coupled to the reflective structure;

wherein at least two of the horizontal metal branches of the radiator units belong to two different layers of the substrate.

10. The antenna structure of claim 9, wherein the reflective structures of the radiator units are coupled to each other.

11. The antenna structure of claim 9, wherein each of the radiator units comprises:

a grounding plate coupled to the reflective structure of the radiator unit and structurally separated from the horizontal metal branch of the radiator unit.

12. The antenna structure of claim 9, wherein the radiator units are at at least one side edge of the substrate.

13. An antenna structure, comprising:

a substrate;

a plurality of vertical radiators in the substrate and spaced from each other;

a reflective structure laterally disposed external to the vertical radiators and having a plurality of first portions and at least one second portion, wherein each of the first portions extends from the at least one second portion toward a nearest one of a plurality of side edges of the substrate, and wherein the at least one second portion extends substantially parallel to at least one of the side edges of the substrate; and a plurality of horizontal metal branches respectively coupled to the first portions of the reflective structure and respectively associated with the vertical radiators.

14. The antenna structure of claim 13, wherein at least two of the horizontal metal branches belong to two different layers of the substrate.

15. The antenna structure of claim 13, wherein a principal plane of the substrate is rectangular, and the at least one second portion of the reflective structure is three second portions respectively parallel to three of the side edges of the substrate.

16. The antenna structure of claim 13, wherein the vertical radiators, the reflective structures and the horizontal metal branches are at at least one of the side edges of the substrate.

17. The antenna structure of claim 13, further comprising:

a plurality of grounding plates respectively coupled to the at least one second portion of the reflective structure and structurally separated from the horizontal metal branches and respectively associated with the vertical radiators.

18. The antenna structure of claim 17, wherein the horizontal metal branches and the grounding plates are alternately disposed in two different layers of the substrate along an extending direction of at least one of the side edges of the substrate.

19. The antenna structure of claim 13, further comprising:

a phased array radiator on the substrate and spaced from the vertical radiators, wherein the at least one second portion of the reflective structure is laterally between the phased array radiator and the vertical radiators.

* * * * *